United States Patent [19]

Shioi et al.

[11] Patent Number: 4,602,264

[45] Date of Patent: Jul. 22, 1986

[54] RECORDING MATERIALS

[75] Inventors: Shunshuke Shioi; Gensuke Matoba, both of Osaka; Makoto Miyake, Hyogo, all of Japan

[73] Assignee: Kanzaki Paper Manufacturing Co., Ltd., Tokyo, Japan

[21] Appl. No.: 522,315

[22] Filed: Aug. 11, 1983

[30] Foreign Application Priority Data

| | | | |
|---|---|---|---|
| Aug. 25, 1982 | [JP] | Japan | 57-148428 |
| Aug. 28, 1982 | [JP] | Japan | 57-149414 |
| Sep. 25, 1982 | [JP] | Japan | 57-167012 |

[51] Int. Cl.[4] ..... B41M 3/14

[52] U.S. Cl. ..... 346/205; 346/211; 346/216; 346/217; 427/150; 427/151; 428/913; 428/914

[58] Field of Search ..... 282/27.5; 427/150, 151; 428/329, 411, 488.1, 537, 913, 914; 346/210, 211, 205, 206, 225

[56] References Cited

U.S. PATENT DOCUMENTS

| | | | |
|---|---|---|---|
| 1,950,982 | 3/1934 | Gookin et al. | 282/27.5 |
| 2,299,693 | 10/1942 | Green | 428/320.4 |
| 2,357,948 | 9/1944 | Gessler et al. | 428/488.1 |

*Primary Examiner*—Edith Buffalow

*Attorney, Agent, or Firm*—Larson and Taylor

[57] ABSTRACT

In a recording material producing images due to a complex formed from an organic phosphorus-iron compound having a bond of $PO^-$ and/or $PS^-$ with $Fe^{3+}$ in the molecule and a ligand compound which reacts with the organic phosphorus-iron compound, the present recording material is characterized in that (a) a colorless or light-colored oil-soluble and/or heat-fusible organic compound adheres to the surface of the organic phosphorus-iron compound and/or (b) an organic base is present out of contact with the organic phosphorus-iron compound. The present invention also provides a desensitizer comprising at least one compound selected from the group consisting of (a) organic phosphorus compounds having a bond of P—OH and/or P—SH, (b) organic compounds having an aminocarboxyl group and (c) salts of these compounds (a) and (b).

11 Claims, No Drawings

RECORDING MATERIALS

This invention relates to recording materials producing images due to a complex formed from a metal compound and a ligand compound and more particularly to recording materials almost without coloring of recording materials and having an excellent initial color forming ability. The term "recording materials" is used herein to mean materials which are employed to prepare recording sheets.

In recent years, pressure sensitive manifold papers, heat sensitive recording papers and electrothermal recording papers employing leuco type recording materials are widely used as recording sheets comprising an electron donating chromogenic material (hereinafter referred to as "color former") such as crystal violet lactone, benzoylleucomethyleneblue, etc. and an electron accepting reactant material (hereinafter referred to as "color acceptor") such as activated clay, phenol resin, polyvalent metal salt of aromatic carboxylic acid, 2,2-bis(4'-oxyphenyl)propane (bisphenol A), etc. However, these recording sheets have found no application in important documents because such recording sheets suffer serious drawbacks that images formed thereon are poor in light resistance although sharp and variable in tone with a lapse of time and are made obscure or effaced by use of a line marker, cellophane tape or the like.

There are known various kinds of chelate type recording sheets which utilize the color forming reaction due to a complex formed from a metal compound and a ligand compound [for example, U.S. Pat. No. 3,912,831, Japanese Examined Patent Publication (Kokoku) No. 5617/1970 and No. 38206/1970]. The recording sheets utilizing the formation of a complex are capable of producing images high in light resistance, hardly variable in tone with a lapse of time and unlikely to be effaced by a line marker, cellophane tape or the like. But such recording sheets mostly fail to form images with a high image intensity, and even recording sheets achieving a high image intensity often involve the use of a ligand compound or metal compound which is deeply colored.

The materials for preparing a complex include trivalent iron compounds. These compounds, however, have thick brown color themselves. Therefore, when used to produce sharp images, the compound act to color strongly the recording sheet to give sheets having low commercial values.

As stated above, conventional recording materials have advantages and disadvantages. It is therefore desired to prepare a recording material having advantages of both leuco type and chelate type recording materials.

We have investigated recording materials utilizing the formation of a complex, found that sharp images were obtained almost without coloring of the recording materials by the use of as a metal compound an organic phosphorus-iron compound having a bond of $PO^-$ and/or $PS^-$ with $Fe^{3+}$ in the molecule and already filed a patent application (e.g., GB No. 2109025A). However, these recording materials have revealed to give images slightly inferior in the initial color forming ability although sharp.

An object of the invention is to provide a chelate type recording material having an excellent whiteness without coloring of recording materials even with use of a relatively inexpensive iron compound as a metal compound.

Another object of the invention is to provide a chelate type recording material which can produce, within a short period of time, sharp images high in light resistance, hardly variable in tone with a lapse of time, scarcely effaceable by a line marker, cellophane tape or the like and extremely improved in both initial and final color forming abilities.

These and other objects of the invention will be apparent from the following description.

In a recording material producing images due to a complex formed from an organic phosphorus-iron compound having a bond of $PO^-$ and/or $PS^-$ with $Fe^{3+}$ in the molecule and a ligand compound which reacts with the organic phosphorus-iron compound, a recording material characterized in that (a) a colorless or light-colored oil-soluble and/or heat-fusible organic compound adheres to the surface of the organic phosphorus-iron compound and/or (b) an organic base is present out of contact with the organic phosphorus-iron compound.

Examples of the organic phosphorus-iron compounds having a bond of $PO^-$ and/or $PS^-$ with $Fe^{3+}$ in the molecule (hereinafter referred to as "PF compound") are those one component of which is at least one of organic phosphorus compounds represented by the following formulae (I) to (XVIII) in which the hydrogen of P—OH or P—SH is substituted with $Fe^{3+}$.

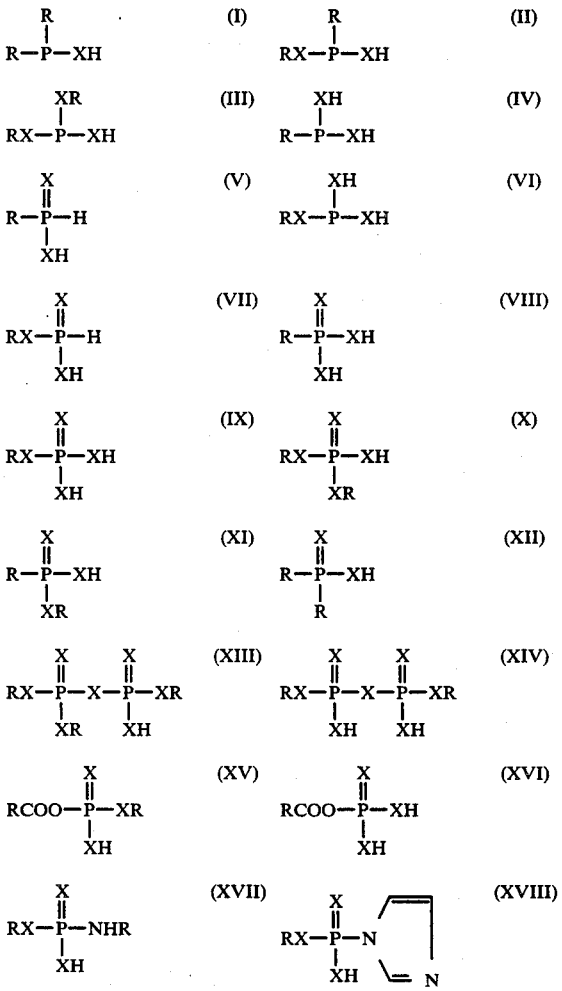

In the above formulae, X is the same or different and represents oxygen atom or sulfur atom and R is the same or different and represents alkyl group or aryl group.

The alkyl groups represented by R include a saturated or unsaturated alkyl group with or without a substituent which alkyl may be any of straight-chain or branched-chain alkyl and cycloalkyl groups. Preferred alkyl groups are those having 1 to 22 carbon atoms except the carbon atoms in the substituent. Examples of the alkyl groups are methyl, ethyl, n-propyl, i-propyl, n-butyl, s-butyl, t-butyl, n-amyl, i-amyl, n-hexyl, t-octyl, n-decyl, n-dodecyl, n-tetradecyl, n-heptadecyl, n-octadecyl, decenyl, dodecenyl, tetradecenyl, heptadecenyl, octadecenyl, decynyl, octadecynyl, cyclohexyl, etc. Among these alkyl groups, more preferred are those having 4 to 20 carbon atoms except the carbon atoms contained in the substituent, and most preferred are saturated alkyl groups having 8 to 20 carbon atoms except the carbon atoms in the substituent. The aryl groups represented by R include those substituted or unsubstituted and are preferably those having 6 to 14 carbon atoms except the carbon atoms in the substituent. Exemplary of such aryl groups are phenyl, naphthyl, anthryl, etc. among which most preferable to use are substituted or unsubstituted phenyl or naphthyl. The alkyl and/or aryl group(s) may form a 5-membered or 6-membered ring with phosphorus atom or with oxygen and/or sulfur atom(s) between phosphorus atom and the groups. The aryl group may form a 5-membered or 6-membered ring between different positions in the same aromatic ring. Illustrated below are examples of the above 5-membered or 6-membered rings. The ring (a) is that formed of two alkyl groups, (b) is a ring formed of two aryl groups, (c) is a ring formed of one alkyl and one aryl group. The rings (d) and (e) are those formed with a bonding between different positions in the same aromatic ring.

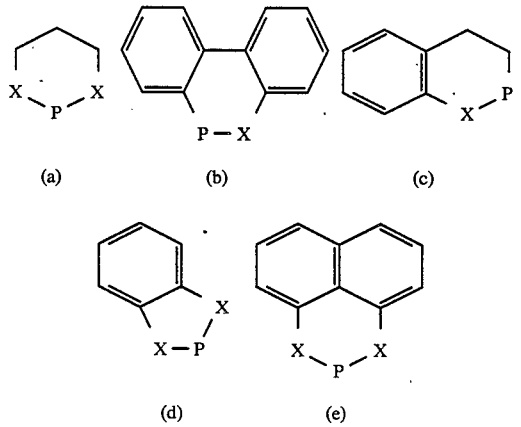

Examples of the substituents for the alkyl groups, aryl groups and these groups forming the 5-membered or 6-membered rings, all represented by R, are chlorine, bromine, fluorine and like halogen atoms; cyano group; hydroxyl group; amino group; carboxyl group; sulfo group; methyl, ethyl, n-propyl, i-propyl, n-butyl, t-butyl, n-hexyl, t-octyl, n-decyl, n-dodecyl, n-tetradecyl, n-heptadecyl, n-octadecyl, vinyl, decenyl, cyclohexyl, methoxyethoxyethyl, benzyl, anisyl $\alpha$-methylbenzyl, and like, saturated or unsaturated, substituted or unsubstituted, straight-chain or branched-chain alkyl groups having 1 to 20 carbon atoms; phenyl, naphthyl, hydroxyphenyl and like substituted or unsubstituted aryl groups; methoxy, ethoxy, propoxy, butoxy, methoxyethoxy and like substituted or unsubstituted alkoxyl groups; phenoxy, tolyloxy, naphthoxy, methoxyphenoxy and like substituted or unsubstituted aryloxyl groups; methoxycarbonyl, butoxycarbonyl, phenoxymethoxycarbonyl and like substituted or unsubstituted alkoxycarbonyl groups; phenoxycarbonyl, tolyloxycarbonyl, methoxyphenoxycarbonyl and like substituted or unsubstituted aryloxycarbonyl groups; formyl, acetyl, valeryl, stearoyl, benzoyl, toluoyl, naphthoyl, p-methoxybenzoyl and like substituted or unsubstituted acyl groups; acetamido, benzoylamino, methoxyacetamido and like substituted or unsubstituted acylamino groups; N-butylcarbamoyl, N,N-diethylcarbamoyl, N-(4-methoxy-n-butyl)carbamoyl and like substituted or unsubstituted carbamoyl groups; N-butylsulfamoyl, N,N-diethylsulfamoyl, N-dodecylsulfamoyl, N-(4-methoxy-n-butyl)sulfamoyl and like substituted or unsubstituted sulfamoyl groups; methylsulfonylamino, phenylsulfonylamino, methoxymethylsulfonylamino and like substituted or unsubstituted sulfonylamino groups; mesyl, tosyl, methoxymethanesulfonyl and like substituted or unsubstituted sulfonyl groups, etc. Among these substituents, more preferable to use are halogen, cyano, hydroxyl, carboxyl, amino, sulfo, substituted or unsubstituted straight-chain or branched-chain alkyl or cycloalkyl having 1 to 20 carbon atoms, substituted or unsubstituted aryl, substituted or unsubstituted alkoxy, substituted or unsubstituted aryloxy, substituted or unsubstituted alkoxycarbonyl, substituted or unsubstituted aryloxycarbonyl, substituted or unsubstituted acyl, and substituted or unsubstituted acylamino. Among them, most preferred are substituted or unsubstituted straight-chain or branched-chain alkyl or cycloalkyl having 1 to 20 carbon atoms and substituted or unsubstituted aryl.

Preferred examples of the groups represented by R in the formulae of the organic phosphorus compounds according to the present invention are alkyl group or aryl group (including phenyl, naphthyl and anthryl) unsubstituted or having the more preferred substituent exemplified above, and containing 4 to 20 carbon atoms except the carbon atoms in the substituent and 4 to 40 carbon atoms including those in the substituent.

More preferable of the groups represented by R are alkyl group (other than those unsaturated) or aryl group (including phenyl and naphthyl) unsubstituted or having the most preferred substituent exemplified above, and containing 6 to 20 carbon atoms except those in the substituent and 6 to 30 carbon atoms including those in the substituent.

With this invention, useful organic phosphorus compounds include a homopolymer formed from a monomer having a bond of P—OH and/or P—SH, a copolymer formed from such monomer and another monomer, and an oligomer thereof. Examples of useful monomer are p-vinylphenyl phosphonic acid and p-vinylphenyl phosphate.

The recording materials of this invention have an important feature in utilizing the color forming reaction between the PF compound and the ligand compound. Two or more types of organic phosphorus compounds including those having the same or different formulae given hereinbefore are usable in mixture as the component of the PF compound.

It is commercially preferred to use as the component of the PF compound an organic phosphorus compound in which X is oxygen, because the compound is readily available.

The object of this invention can be accomplished by forming a complex from the PF compound and the ligand compound. The color forming properties of the recording materials according to the invention are markedly improved by using a composite iron salt resulting from the reaction between $Fe^{3+}$ and at least one of the organic phosphorus compounds of the formulae (I) to (XVIII) and at least one of acids represented by the formula

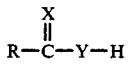

(XIX)

wherein R and X are as defined above and Y is oxygen or sulfur. The above composite iron salt is hereinafter referred to as "two-component composite salt."

The acids of the formula (XIX) include a carboxylic acid, thio-acid and dithioic acid. With this invention, useful carboxylic acids include a homopolymer, copolymer and oligomer of a monomer having a carboxylic group such as p-vinylbenzoic acid.

Preferable of the acids of the formula (XIX) are those in which the group represented by R is alkyl group or aryl group (including phenyl, naphthyl and anthryl) unsubstituted or having the more preferred substituent exemplified above and containing 4 to 20 carbon atoms except the carbon atoms in the substituent and 6 to 30 carbon atoms including the carbon atoms in the substituent. More preferred acids are those in which the group represented by R is alkyl group (other than those unsaturated) or aryl group (including phenyl and naphthyl) unsubstituted or having the most preferred substituent exemplified above and containing 6 to 20 carbon atoms except the carbon atoms in the substituent and 12 to 24 carbon atoms including the carbon atoms in the substituent. It is commercially preferred to use the acid of the formula (XIX) wherein X and Y are both oxygen, because such acids are readily available. Specific examples of the most preferred acids are stearic acid, benzoic acid, 4-tert-butylbenzoic acid, 4-n-pentylbenzoic acid, 4-n-octylbenzoic acid, 1-naphthoic acid, etc.

The molar ratio of the acid of the formula (XIX) to the organic phosphorus compound contained in the above two-component composite salt is not particularly limited. However, with the acid used in excess, it is impossible to produce recording materials having an improved whiteness as contemplated. The acid is used in an amount of preferably up to 250 moles, more preferably 30 to 200 moles, per 100 moles of the organic phosphorus compound.

In the invention, it is more preferable to use a composite iron salt obtained by a conjoint use of an organic sulfur compound having a bond of S-OH in the preparation of the two-component composite salt, thereby recording materials having more improved whiteness are obtained with the possession of excellent color forming ability of the two-component composite salt. This composite iron salt is hereinafter referred to as "three-component composite salt."

The organic sulfur compounds having a bond of S-OH include a sulfonic acid, sulfinic acid and sulfate. Examples of useful organic sulfur compounds are benzenesulfonic acid, alkylbenzenesulfonic acid, naphthalenesulfonic acid, alkylnaphthalenesulfonic acid, polystyrenesulfonic acid, dialkylsulfosuccinic acid, alkylbenzenesulfinic acid, alkyl sulfate, etc. Preferred alkyl groups are saturated, straight-chain alkyls having 1 to 20 carbon atoms without a substituent.

The molar ratio of the organic sulfur compound is used in an amount of preferably 2 to 100 moles, more preferably 5 to 30 moles, per 100 moles of the organic phosphorus compound.

With this invention, the process for preparing the PF compound (hereinafter includes also two-component and three-component composite salts) are not specifically limited. For example, the PF compound can be prepared by bringing an aqueous solution of alkali metal salt, preferably sodium salt, of the organic phosphorus compound into contact with an aqueous solution of ferric salt such as ferric chloride or ferric sulfate to precipitate a ferric salt of the organic phosphorus compound. Exemplary of the processes for preparing the two- or three-component composite iron salt is a process comprising bringing an aqueous solution containing an alkali metal salt of the organic phosphorus compound, an alkali metal salt, preferably sodium salt, of the acid (XIX) and, when desired, an alkali metal salt, preferably sodium salt, of the organic sulfur compound into contact with an aqueous solution of ferric salt to produce a precipitate. In order to change the tone of images, it is possible to add a metal ion other than $Fe^{3+}$ ion. Examples of the metal ions are $Ca^{2+}$, $Mg^{2+}$, $Al^{3+}$, $Zn^{2+}$, $Cd^{2+}$, $Cu^{2+}$, $Ti^{4+}$, $Sr^{2+}$, $Ba^{2+}$, $Fe^{2+}$, $Co^{2+}$, $Ni^{2+}$, $Mn^{2+}$, $Pb^{4+}$, etc. These metal ions can be used in admixture of at least two of them.

In this invention, the PF compound may be used singly or in admixture.

Useful as the ligand compound for the complex is any suitable compound capable of reacting with the PF compound to form a complex exhibiting color forming properties. Examples of such compounds are di-n-butylammonium-di-n-butyldithiocarbamate, t-octylammonium-t-octyldithiocarbamate, stearyltrimethylammoniumethylenebisdithiocarbamate, dibenzothiazyldisulfide, toluene-3,4-dithiol, benzoylacetone, dibenzoylacetone, salicylic acid, 3,5-di(α-methylbenzyl)salicylic acid, hydroxynaphthoic acid, naphthoic acid hydroxyethylamide, naphthoanilide, 2-hydroxy-1-naphthoaldehyde, tropolone, hinokitiol, methoxyhydroxyacetophenone, resorcin, t-butylcatechol, dihydroxybenzenesulfonic acid, gallic acid, ethyl gallate, propyl gallate, isoamyl gallate, octyl gallate, lauryl gallate, benzyl gallate, tannic acid, pyrogallol tannin, protocatechuic acid, ethyl protocatechuate, pyrogallol-4-carboxylic acid, alizarin, N-nitrosonaphthyl hydroxyamine ammonium salt, diphenylcarbazide, 8-hydroxyquinoline, dichloro-8-hydroxyquinoline, dibromo-8-hydroxyquinoline, chlorobromo-8-hydroxyquinoline, methyl-8-hydroxyquinoline, butyl-8-hydroxyquinoline, lauryl-8-hydroxyquinoline, methylenebis(8-hydroxyquinoline), N-benzoyl-N-phenyl-hydroxylamine, salicylaldoxime, anthranilic acid, quinolinecarboxylic acid, nitrosonaphthol, 2-mercaptoimidazoline, diphenylthiocarbazone, 6-ethoxy-2,2,4-trimethyl-1,2-dihydroquinoline, 6-phenyl-2,2,4-trimethyl-1,2-dihydroquinoline, 6-decyl-2,2,4-trimethyl-1,2-dihydroquinoline, 2-imidazoline, phenyl-α-naphthylamine, phenyl-β-naphthylamine, zinc butyl xanthate, zinc salicylate, zinc 3,5-di(α-methylbenzyl)-salicylate, etc. Preferable of these ligand compounds are gallic acid, ethyl gallate, propyl gallate, isoamyl gallate, octyl gallate, lauryl gallate, benzyl gallate, tannic acid, protocatechuic acid, ethyl protocatechuate, etc., because these compounds are readily available and colorless themselves.

When other metal ion is used conjointly with the PF compound, a specific ligand compound is usable. For example, N,N'-dibenzyldithiooxamide is usable when $Ni^{2+}$ is used as a metal ion and 1,10-phenanthroline for $Fe^{2+}$.

The recording materials of this invention are characterized in that (a) a colorless or light-colored oil-soluble and/or heat-fusible organic compound adheres to the surface of the PF compound and/or (b) an organic base is present out of contact with the PF compound. With the adhesion of the organic compound to the surface of the PF compound, coloring of the recording materials greatly decreases almost without affecting the recording sensitivity. Further, with the use of the organic base, both of the initial and final color forming abilities are greatly improved.

The amount of the oil-soluble and/or heat-fusible organic compound which adhere to the surface of the PF compound fine particles is suitably adjustable depending on kinds of the organic compound, the PF compound and the recording sheet, etc. Generally, the organic compound is used preferably up to 300 wt %, more preferably up to 150 wt % of the PF compound in order not to affect the color sensitivity. The organic compound adheres to the PF compound in an amount of preferably at least 10 wt %, more preferably at least 20 wt % to eliminate the coloring of the materials.

With the invention, the organic compound adheres to the surface of the PF compound fine particles by various processes. The following is one of processes for preparing recording materials having excellent quality with high efficiency. Namely, the organic compound adheres to the surface of the PF compound fine particles in the form of organic acid and/or organic metal salt by dispersing the PF compound fine particles in an aqueous medium, adding thereto at least one of alkali metal salt of organic acids and further adding at least one of metal ions and/or $H^+$ ion.

Examples of useful organic acids are various organic acids such as an organic phosphorus compound having a bond of P—OH or P—SH, carboxylic acid, thio-acid, dithioic acid, organic sulfur compound having a bond of S—OH, these being usable for preparing the aforementioned PF compound fine particles. Preferred metal ions are $Ca^{2+}$, $Mg^{2+}$, $Al^{3+}$, $Zn^{2+}$, $Cd^{2+}$, $Cu^{2+}$, $Ti^{4+}$, $Sr^{2+}$, $Ba^{2+}$, $Fe^{2+}$, $Fe^{3+}$, $Co^{2+}$, $Ni^{2+}$, $Mn^{2+}$, $Pb^{4+}$, etc. These metal ions are used in such that the oil-soluble and/or heat-fusible organic compounds may form colorless or light-colored salts by the ion-exchange with the above alkali metal salt of the organic acids. These metal ions are used usually in the form of halogenide, sulfate, nitrate, etc. As $H^+$ ion sources, hydrochloric acid, sulfuric acid, nitric acid, acetic acid and the like are used.

In the invention, it is possible that the organic compound adheres to the surface of the PF compound fine particles with employing the preparation system of the PF compound in a continuous way. The organic acid usable for preparing the PF compound fine particles are also employable as materials in the process of the adhesion of the organic compounds, whereby the recording materials of the invention can be obtained with extremely high efficiency.

In the invention, the organic base includes various compounds such as an aliphatic amine, aromatic amine, alicyclic amine, amidine, guanidine, nitrogen-containing heterocyclic compound, heterocyclic amine, etc. Given below are examples of useful organic bases to which, however, they are not limited. Examples thereof are tripropylamine, tri(n-octyl)amine, tribenzylamine, N-dimethylbenzylamine, di(2-ethylhexyl)amine, didodecylamine, dioctadecylamine, dibenzylamine, dodecylamine, hexadecylamine, octadecylamine, N-dibutylphenylamine, N-diethyl-p-tolylamine, N-dibenzylphenylamine, N-ethyl-N-benzylphenylamine, N-diphenylmethylamine, N-dodecylphenylamine, diphenylamine, N-naphthylphenylamine, N-(p-octylphenyl)-phenylamine, mesidine, dicyclohexylamine, N,N'-diphenylformamidine, 1,3-diphenylguanidine, 1,1,3,3-tetraphenylguanidine, pyridine, quinoline, morpholine, 1,2,3,4-tetrahydroquinoline, amines of the formulae

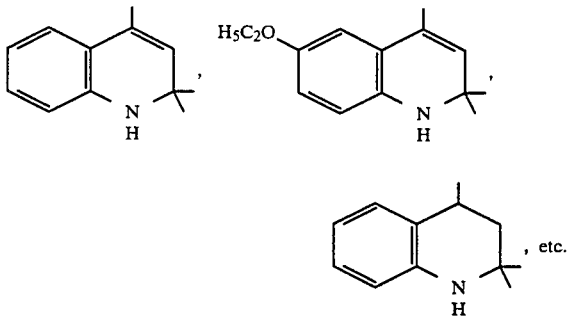

The organic base is employed in an amount of usually 0.01 to 300% by weight of the PF compound, although the amount varies with the kind of the base and the recording material contemplated.

In one of embodiments of the invention, the organic base is used with specific PF compound and ligand compound. The organic base is present in the recording material preferably out of contact with the PF compound in order to prevent the coloring of the PF compound. To this purpose, it is preferable to interpose a binder between the organic base and the PF compound, to microencapsulating at least one of them or to bring them to different layers.

When the organic base is microencapsulated in latermentioned preparation of pressure sensitive manifold paper to prevent a contact with the PF compound, it is preferable to use an organic base having at least one aromatic hydrocarbon group in the molecule because of excellent solubility in an organic solvent for microencapsulation.

The recording materials of this invention are usable for preparing pressure sensitive manifold papers, heat sensitive recording papers, electrothermal recording papers or the like. The invention will be described below with regard to a pressure sensitive manifold paper which is a typical embodiment of the invention.

Pressure sensitive manifold papers are recording sheets which utilize the principle that a color former such as crystal violet lactone, benzoylleucomethyleneblue, etc. and a color acceptor such as activated clay interact to produce color marks. Such manifold papers comprise a top sheet, an under sheet and, if two or more copies are to be produced, one or more middle sheets. The top sheet (CB) has one surface of the support coated with color former-containing microcapsules prepared by any suitable process such as coacervation process, interfacial polymerization process and in-situ polymerization process. The under sheet (CF) has one surface of the support coated with a color acceptor. The middle sheet (CFB) has one surface of the support coated with color former-containing microcapsules and the other surface thereof coated with a color acceptor. There are also used pressure sensitive manifold papers of the self-contained type having one surface of the support covered with a laminate of, or a mixture of, color former-containing microcapsules and a color acceptor.

When the recording materials of this invention are used to prepare pressure sensitive manifold papers, any one or, when required, at least two of the PF compound, ligand compound and organic base may be encapsulated. When desired, at least two of these compounds are encapsulated in the same capsule. However, when the oil-soluble and/or heat-fusible organic compound adheres to the PF compound, the PF compound should not be encapsulated in order not to affect the improvement with the organic compound.

In encapsulation, the PF compound, the ligand compound or the organic base is contained in an organic solvent. The organic solvent to be used for this purpose is preferably high in solubility and involatile or low in volatility. Given below are examples of useful organic solvents to which, however, they are not limited. These solvents are usable singly or in mixture. Examples thereof are cotton seed oil and like vegetable oils, kerosene, paraffin, naphthene oil, chlorinated paraffin and like mineral oils, alkylated biphenyl, alkylated terphenyl, alkylated naphthalene, diarylethane, triarylmethane, diphenylalkane and like aromatic hydrocarbons, oleyl alcohol, tridecyl alcohol, benzyl alcohol, 1-phenylethyl alcohol, glycerin and like alcohols, oleic acid and like organic acids, dimethyl phthalate, diethyl phthalate, di-n-butylphthalate, dioctyl phthalate, diethyl adipate, dipropyl adipate, di-n-butyl adipate, dioctyl adipate and like esters, tricresyl phosphate, tributyl phosphate, tributyl phosphite, tributyl phosphine oxide and like organic phosphorus compounds, phenyl cellosolve, benzylcarbitol, polypropylene glycol, propylene glycol monophenyl ether and like ethers, N,N-dimethyllaurylamide, N,N-dimethylstearylamide, N,N-dihexyloctylamide and like amides, diisobutyl ketone, methyl hexyl ketone and like ketones, ethylene carbonate, propylene carbonate and like alkylene carbonates, etc.

The encapsulation can be conducted by any of known processes such as coacervation process, interfacial polymerization process, in-situ polymerization process, etc. Preferable of these conventional processes are those disclosed in Japanese Examined Patent Publication No. 16949/1979 (U.S. Pat. No. 4,001,140) and Japanese Unexamined Patent Publication No. 84881/1978 (U.S. Pat. No. 4,087,376) in which urea formaldehyde resin and melamine formaldehyde resin are used as the wall-forming material. The organic base is preferably encapsulated by the process disclosed in Japanese Unexamined Patent Publication No. 76138/1983 in which aminoaldehyde resin is used as the wall-forming material. When desired, an antioxidant, ultraviolet ray absorbing agent may be incorporated in the microcapsule. The microcapsules thus obtained are mixed, when required, with auxiliaries usually used in the art to which this invention pertains, whereby a capsule coating composition is prepared. Typical of useful auxiliaries are water-soluble or latex type binder, capsule-protecting agent, pigment, dispersing agent, antifoaming agent, antiseptic, fluorescent white dye, colored dye, pH adjusting agent, etc. Useful water-soluble binders include natural high molecular weight compounds such as gelatin, albumin, casein and like proteins, corn starch, α-starch, oxidized starch, etherified starch, esterified starch and like starches, carboxymethyl cellulose, hydroxyethyl cellulose and like celluloses, agar, sodium alginate, gum arabic and like saccharoses, synthetic high molecular weight compounds such as polyvinyl alcohol, polyvinyl pyrrolidone, polyacrylic acid, polyacrylamide, maleic acid copolymer, etc. Examples of useful latex binders are styrene-butadiene latex, acrylonitrile-butadiene latex, acrylic ester latex, vinyl acetate latex, methyl methacrylate-butadiene latex and carboxy-modified (e.g. acrylic acid) latex thereof, etc. Examples of useful capsule-protecting agents are cellulose powder, starch granules, etc. Examples of useful pigments are talc, calcined kaolin, calcium carbonate, etc. The amounts of the binder, capsule-protecting agent and pigment to be used are not particularly limited.

The ligand compound, the PF compound or the organic base, when not encapsulated, is pulverized as required by a ball mill, attritor, sand mill, etc. and mixed with auxiliaries usually used such as white pigment, binder, dispersing agent, colored dye, fluorescent white dye, ultraviolet ray absorbing agent, antioxidant, acid or like stabilizers, etc. to prepare a coating composition. It is preferred to pulverize the ligand compound, the PF compound or the organic base by using water. Dispersing agents useful for wet pulverization and also for preparing coating compositions include low molecular weight and high molecular weight dispersing agents and surfactants. Examples thereof are sodium alkylsulfate, sodium alkylbenzenesulfonate, sodium alkylnaphthalenesulfonate, sodium polystyrenesulfonate, sodium oleic acid amide sulfonate, sodium dialkylsulfosuccinate, sulfonated castor oil and like anionic surfactants, trimethylaminoethylalkylamide halide, alkyl pyridinium sulfate, alkyl trimethyl ammonium halide and like cationic surfactants, polyoxyethylenealkyl ether, polyoxyethylene fatty acid ester, polyoxyethylenealkyl phenyl ether, polyhydric alcohol ester of fatty acid, polyoxyethylene polyhydric alcohol ester of fatty acid, cane sugar ester of fatty acid and like nonionic surfactants, alkyl trimethylaminoacetic acid, alkyl diethylenetriaminoacetic acid and like amphoteric surfactants, starch, phosphated starch, polyvinyl alcohol, carboxymethyl cellulose, sodium alginate, sodium polyacrylate, sodium salt of vinyl acetate-maleic anhydride copolymer, ammonium salt of styrene-maleic anhydride copolymer, sodium salt of butadiene-methacrylate copolymer and like water-soluble high molecular weight compounds, etc. Examples of useful white pigments are oxide, hydroxide, carbonate, sulfate, phosphate, silicate and halogenated compounds of aluminum, zinc, magnesium, calcium and titanium, and silica, terra abla, activated clay, attapulgite, zeolite, bentonite, kaolin, calcined kaolin, talc and like clays, etc. Usable as the binder are those useful for preparation of the capsule coating composition. These binders are used singly or in mixture.

When pressure sensitive manifold papers are prepared by using the recording materials of this invention, the ligand compound is favorably encapsulated to improve the stability of the compound.

The coating composition thus prepared for recording materials is applied to substrates in the conventional manner to produce pressure sensitive manifold papers.

In preparing heat sensitive recording papers or electrothermal recording papers by using the recording materials of this invention, a coating composition can be prepared by the known process, employing the ligand compound, the PF compound and, when desired, the organic base of this invention in place of the conventional color former and color acceptor, together with auxiliaries known in the field.

When producing heat sensitive recording papers, finely divided particles of each of the ligand compound, the PF compound or the organic base are dispersed in a medium having a binder dissolved or dispersed therein to obtain a dispersion. The dispersions thus prepared are mixed together to produce a coating composition which is then applied to a support of the paper. Alternatively the dispersions are made into coating compositions which are then applied in layers to a support of the paper, whereby heat sensitive recording papers are obtained.

The binder to be used for preparing the coating composition is suitably selected from starches, hydroxypropyl cellulose and like celluloses, proteins, gum arabic, polyvinyl alcohol, salt of styrene-maleic anhydride copolymer, emulsion of styrene-butadiene copolymer, salt of vinyl acetate-maleic anhydride copolymer, polyacrylate, etc. In order to improve the color forming ability, delustering, writing properties and the coloring of the coating composition, when required, the coating composition may have incorporated therein oxide, hydroxide and carbonate of polyvalent metal and like inorganic metal compounds, inorganic pigment, dispersing agent, ultraviolet ray absorbing agent, thermally melting agent, antifoaming agent, fluorescent dye, colored dye, later-mentioned desensitizer, etc.

Electrothermal recording papers are prepared by applying to a support of the paper a coating composition having dispersed therein the PF compound, the ligand compound, the organic base as desired, an electroconductive material and a binder or by applying such coating composition excluding the electroconductive material to an electroconductive support of the paper which is prepared by covering the support with an electroconductive material. When the ligand compound, the PF compound and the organic base are unable to melt at a preferable temperature of 70° to 120° C., it is possible to adjust the sensitivity to Joule's heat by using an adequate thermally melting agent.

When pressure sensitive manifold papers, heat sensitive recording papers or electrothermal recording papers are prepared, the coating composition is applied by an air knife coater, roll coater, blade coater, rod blade coater, size press coater, curtain coater, bill blade coater, short dwell coater or the like to a suitable substrate such as paper, synthetic fiber paper, synthetic resin film or the like. The coating may be formed by printing on the substrate aqueous or solvent type flexographic ink, letterpress ink, lithographic ink, UV curable ink, EB (electron beam) curable ink or the like into which at least one of the ligand compound, PF compound and the organic base is formulated.

The recording materials of this invention can be used conjointly with other chelate type, leuco type or like recording materials in order to give the variation in tone of the images and to improve the color forming ability of the recording sheets.

According to this invention, the ligand compound and the PF compound are employed in an amount of usually about 0.2 to about 10 g/m$^2$, preferably about 0.2 to about 6 g/m$^2$, although the amount varies with the kind of the materials, content of the materials in a coating composition and a specific purpose.

The present chelate type recording materials, as stated above, produce sharp images high in light resistance, hardly variable in tone with a lapse of time, scarcely effaceable by a line marker, cellophane tape or the like. For leuco type recording sheets are developed desensitizers which are applied to a predetermined area requiring no color-formation. However, desensitizers are yet to be developed in chelate type recording materials. Thus, chelate type recording materials have a limited use which requiring no desensitizer.

We have investigated desensitizers which are useful for chelate type recording sheets having excellent properties as mentioned above and found the following excellent desensitizer.

This invention also provides a desensitizer for chelate type recording sheets which comprises at least one of (a) an organic phosphorus compound having a bond of P—OH or P—SH, (b) an organic compound having an aminocarboxyl group and (c) a salt of these (a) and (b).

Examples of useful organic phosphorus compounds are those employed in the previous recording materials and represented by the formulae (I) to (XVIII). The organic phosphorus compounds further include various phosphates of alkylene glycols. The following are preferred examples thereof.

Phosphates of glycols of the formula

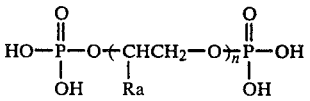

wherein n is an integer of 1 to 20 and Ra is H or $CH_3$. Preferable examples thereof are phosphates of glycols such as ethylene glycol, propylene glycol, diethylene glycol, dipropylene glycol, triethylene glycol, tripropylene glycol, polyethylene glycol, polypropylene glycol, etc.

Phosphates of polyoxyalkyleneamines of the formulae

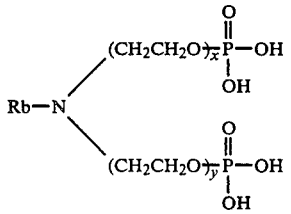

wherein Rb is alkyl having 1 to 18 carbon atoms, (x+y) is an integer of 4 to 20,

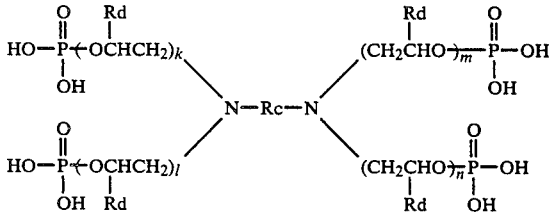

wherein Rc is a straight-chain or branched-chain alkylene having 2 to 6 carbon atoms, Rd is H or $CH_3$, (k+l+m+n) is an integer of 4 to 24,

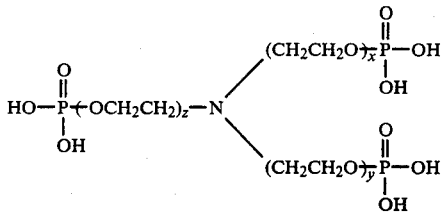

wherein (x+y+z) is an integer of 3 to 24, and

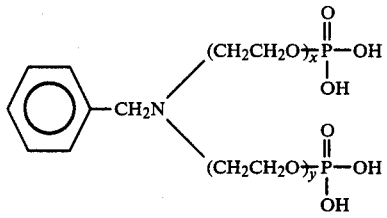

wherein (x+y) is an integer of 2 to 12.

Among the above organic phosphorus compound having a bond of P—OH or P—SH, phosphates of alkylene glycols are especially preferable because of their excellent desensitizing ability, easy handling thereof, small migration after the printing thereof, etc.

Examples of useful organic compounds having a aminocarboxyl group are ethylenediaminetetraacetic acid (EDTA), diethylenetriaminepentaacetic acid (DTPA), triethylenetetraminehexaacetic acid (TTHA), tetraethylenepentaminheptaacetic acid (TPHA), N-(2-hydroxyethyl)ethylenediamine-N, N',N'-triacetic acid(-HEDTA), ethylenediamine-N,N,N',N'-tetrapropionic acid (EDTP) and like polyalkylenepolyamine polycarboxylic acids, trans-1,2-cyclohexanediaminetetraacetic acid (CyDTA) and like cycloalkanepolyamine polycarboxylic acids, glycol ether diaminetetraacetic acid (GEDTA) and like ether polyamine polycarboxylic acids, nitrilotriacetic acid (NTA), these acids having substituent(s), etc.

Further, the following organic compounds having the formulae below are included.

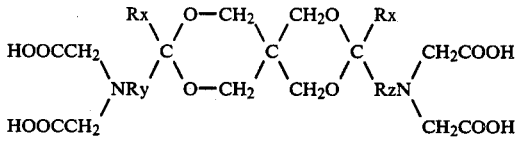

wherein Rx is H or alkyl, Ry and Rz are straight-chain or branched-chain alkylene having 1 to 6 carbon atoms.

A homopolymer, copolymer or oligomer prepared from a vinyl monomer having the formulae

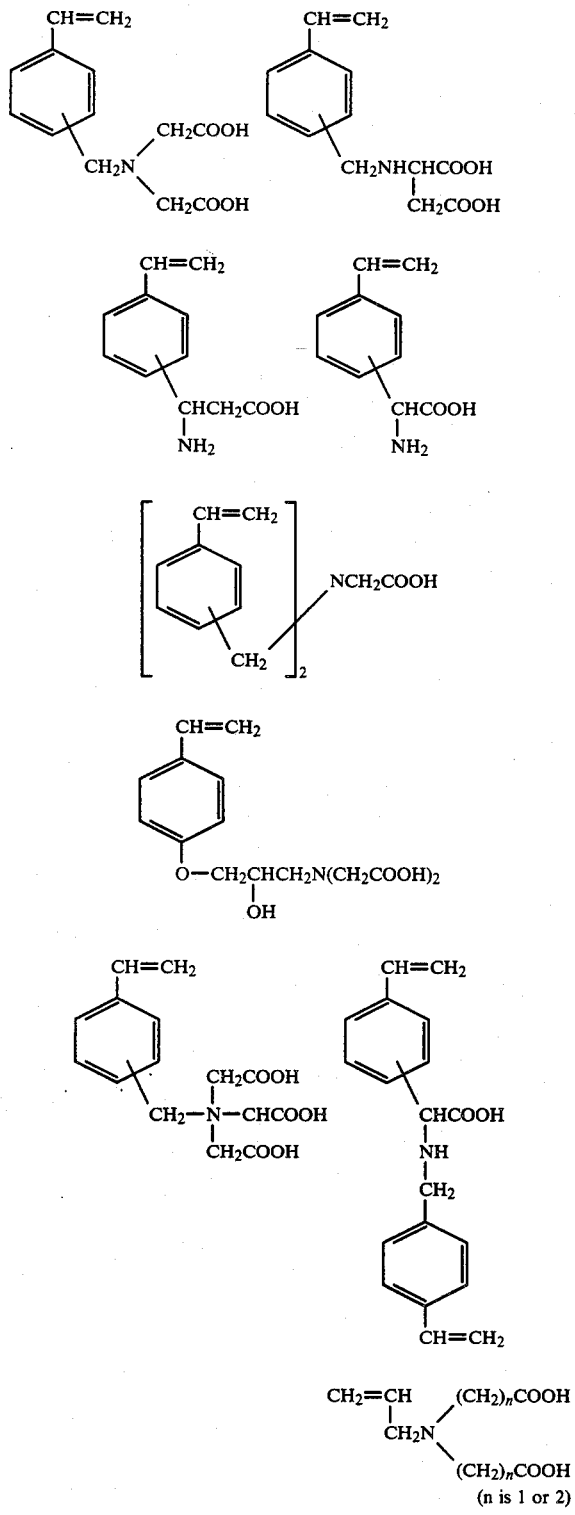

A polymer or oligomer having the following recurring units

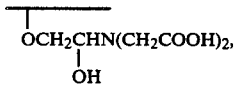

-continued

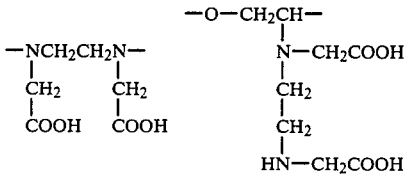

Examples of useful salts of the above organic phosphorus compounds and the organic compounds having a aminocarboxyl group are lithium, sodium, potassium and like alkali metal salts, calcium, magnesium and like alkaline earth metal salts, ammonium salt, etc. These compounds and salts thereof are usable singly or in mixture in the preparation of the desensitizer according to the desired properties. Also usable are compounds or salts thereof having a bond of P—OH and/or P—SH and a aminocarboxyl group in the same molecule.

The desensitizer of the invention may contain other components usually used in the conventional desensitizer and not particularly limited. Examples of other components are ketone resin, polyamide resin, maleic acid resin, fumaric acid resin, phenol resin, epoxy resin, alkyd resin, melamine resin, urea resin, acrylic resin, nitrocellulose, methyl cellulose, cellulose acetate butyrate, butyral resin, casein, gelatin, polyvinyl alcohol and like natural or synthetic high molecular weight compounds (these compounds are in most cases used as a binder but not limited thereto); titanium oxide, zinc oxide, barium sulfate, magnesium carbonate, calcium carbonate, barium carbonate, magnesium hydroxide, talc and like pigments (these compounds improve printability, whiteness and hiding power); ethylene glycol, diethylene glycol, glycerin, polyethylene glycol, polypropylene glycol and like glycols, and alcohols (these are usable as a solvent); paraffin, Japan wax and like fats and oils (these improve friction resistance); linseed oil, tung oil, soybean oil and like drying oil, cotton seed oil, rape oil, rice bran oil and like semi-drying oil; other known additives such as starch and like off setting preventing agents. The desensitizer of the invention may be in various forms such as an aqueous solution, organic solvent solution (e.g. alcoholic solution), aqueous dispersion, paste, solid, etc.

The desensitizer can be prepared in a usual manner and applied to a support by various methods such as printing, spraying, hand-writing etc. The desensitizer can be formulated into letterpress ink, flexographic ink, gravure ink, offset ink, UV curable ink, EB curable ink and like inks; crayon; eraser, etc.

The desensitizer of the invention can be applied to various chelate type recording sheets. Examples thereof are a pressure sensitive manifold paper, heat sensitive recording paper, electrothermal recording paper, each of them using chelate color forming reactions. As other recording sheets are included those used in spirit printing, stencil printing, ticket vending system, fingerprint taking system, letter writing system, etc. Among those, pressure sensitive manifold papers are especially usable.

In the invention, the desensitizer can be used with or without the adhesion of the oil-soluble and/or heat-fusible organic compound to the surface of the PF compound, and/or the incorporation of the organic base.

As stated above, the invention relates to recording materials which are characterized in that (a) the specific organic compound adheres to the PF compound surface and/or (b) the specific organic base is present out of contact with the PF compound, have a greatly decreased coloring of the recording materials and exhibit greatly improved initial and final color forming abilities.

However, when the recording materials of the invention are used in the preparation of pressure sensitive manifold papers, the following various improvements or betterments are employable with or without the above adhesion of the organic compound and/or the incorporation of the organic base.

Firstly, it is found that an undesirable coloring of the recording layers are likely to occur, when the present recording materials are applied to pressure sensitive manifold papers, especially those of self-contained type. This is presumably caused by a lamination or mixing of the PF compound and the ligand compound in the recording layers.

We have studied to eliminate the above problem and found that self-contained type pressure sensitive manifold papers can be obtained without the above undesirable coloring by microencapsulating both of the PF compound and the ligand compound, using a synthetic resin as wall-forming material in at least one capsule and further employing conjointly an oil-absorbing pigment.

As stated above, in this self-contained type pressure sensitive manifold paper, both of the PF compound and the ligand compound are microencapsulated. The encapsulation can be carried out by any of known processes such as coacervation process, interfacial process, in-situ polymerization process, etc. It is essential to use a synthetic resin as wall-forming material in at least one capsule among those containing the PF compound and the ligand compound respectively to eliminate the above coloring which is likely to occur especially when manifold papers are placed at a high temperature and humidity. Examples of useful wall-forming materials are melamine-formaldehyde resin, urea-formaldehyde resin, urethane resin, urea resin, nylon resin, etc. Preferred encapsulation processes are those employing urea-formaldehyde resin and melamine-formaldehyde resin which are disclosed in U.S. Pat. Nos. 4,001,140 and 4,087,376, thereby giving excellent capsules.

In the above self-contained type pressure sensitive manifold paper, the oil-absorbing pigment is used conjointly with the capsules. Examples of useful oil-absorbing pigments are oxide, hydroxide, carbonate, sulfate, phosphate, halogenated compounds of aluminum, zinc, magnesium, calcium and titanium; terra abla, activated clay, attapulgite, zeolite, bentonite, kaolin, calcined kaolin and like clays; urea resin powder, melamine resin powder, etc. The oil-absorbing pigment effectively absorbs organic solvents which flow out from capsules containing the PF compound and the ligand compound, giving sharp images. The pigment is pulverized and dispersed as required by a ball mill, attritor, sand mill, etc.

A recording layer may be formed on a support by various methods, for example, (a) by coating to a support a coating composition containing respective microcapsules of the PF compound and the ligand compound, and the oil-absorbing pigment, (b) by coating to a support a coating composition containing respective microcapsules and forming on the coating layer a layer of the oil-absorbing pigment, (c) by coating to a support a coating composition containing a microcapsule of the PF compound and forming on the coating layer a layer of a microcapsule containing the ligand compound and the oil-absorbing pigment, (d) by coating to a support a coating composition containing a microcapsule of the ligand compound and forming on the coating layer a layer of a microcapsule containing the PF compound and the oil-absorbing pigment, etc.

It is possible to add the obvious variations and modifications within the spirit of the invention. For example, other chelate type and leuco type recording materials can be employed conjointly with the above self-contained type pressure sensitive manifold paper to improve the color forming ability of the images and change the tone thereof. In the modifications are included so-called double self-contained type pressure sensitive manifold papers which are already developed in the leuco type self-contained papers and have a back surface coated with a microcapsule layer.

In the self-contained type pressure sensitive manifold papers thus obtained, the coloring of the recording layers are effectively prevented. Moreover, with the encapsulation of both of the ligand compound and the PF compound, the ligand compound hardly changes to yellow color with a lapse of time due to air-oxidation, and the coloring of the PF compound is greatly reduced even at a high temperature and humidity. Thus, manifold papers high in commercial values are obtained.

Secondly, we have studied to utilize only merits of the respective leuco type and chelate type recording materials and reached to obtain an excellent pressure sensitive manifold paper having high resistances to light and plasticizer, and capable of giving many kinds of tone with a low cost, by microencapsulating both types of recording materials separately.

The pressure sensitive manifold papers stated above comprise (a) a leuco type record material in which at least one of color former and color acceptor is microencapsulated and (b) a chelate type record material in which at least one of the PF compound and the ligand compound is microencapsulated.

Any of color formers known in the pressure sensitive manifold papers are usable. Examples of useful color formers are:

Triarylmethane-based dyes, e.g., 3,3-bis(p-dimethylaminophenyl)-6-dimethylaminophthalide(crystal violet lactone), 3,3-bis(p-dimethylaminophenyl)phthalide, 3-(p-dimethylaminophenyl)-3-(1,2-dimethylindole-3-yl) phthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoylleucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenylspirodinaphthopyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-7-chlorofluoran, 3-diethylamino-6,7-dimethylfluoran, 3-(N-ethyl-p-toluidino)-7-methylfluoran, 3-diethylamino-7-dibenzylaminofluoran, 3-diethylamino-7-N-chloroethyl-N-methylaminofluoran, 3-(N-ethyl-p-toluidino)-6-methyl-7-phenylaminofluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-diethylamino-7-(o-chlorophenylamino) fluoran, etc. These dyes are used singly or in mixture.

Any of color acceptors usually used in the pressure sensitive manifold papers are employable. Examples of useful color acceptors are terra abla, activated clay, attapulgite, zeolite, bentonite and like clays, phenol resin, polyvalent metal salt of aromatic carboxylic acid disclosed for example in Japanese Examined Patent Publication No. 25174/1976, zinc salt of 2,2'-bisphenol sulfonic compound described for example in Japanese Unexamined Patent Publication No. 106316/1979, etc. These compounds are used singly or in mixture.

The phenol resins are those release proton which are known in the art. Examples thereof are p-phenylphenol-formaldehyde polymer and like phenol-aldehyde polymer (so-called novolak type), phenol-acetylene polymer, etc.

Examples of useful metal salts of aromatic carboxylic acids are copper, lead, magnesium, calcium, zinc, aluminum, tin, nickel and like metal salts of aromatic carboxylic acids and derivatives thereof. Examples of useful aromatic carboxylic acids are benzoic acids, salicylic acids, naphthoic acids, etc. More concrete examples thereof are benzoic acid, salicylic acid, 3,5-di-tert-butylsalicylic acid, 3,5-di-$\alpha$-methylbenzylsalicylic acid, naphthoic acid, etc. The organic compounds are preferable than clays or like inorganic compounds for a color acceptor when used in the form of microcapsules.

In the above pressure sensitive manifold papers, at least one component of the respective leuco type and chelate type recording materials are separately microencapsulated. Accordingly, this manifold paper exhibits a particularly excellent effect when a compound having a phenolic hydroxyl group is used as the ligand compound, since such phenolic compound will form a deep color when contacted with color former of leuco type recording materials in microcapsules.

The pressure sensitive manifold papers thus obtained have excellent resistances to light and plasticizer and are capable of giving various kinds of tone easily. However, in case of forming a microcapsule layer comprising those containing a compound having a phenolic hydroxyl group and a color former respectively, these two compounds, when copying, not only flow out from the capsules and transfer to a color acceptor layer but also contact with each other in the capsule coating layer to form a color. Accordingly, it is preferable to incorporate a small amount of desensitizer for the leuco type recording materials in the capsule layer and/or the recording substrate. Examples of useful desensitizers are polyoxyethylene alkylamine, polyoxyethylene alkyl ether, polyoxyethylene ester, polyoxyethylene alkyl phenyl ether, polyethylene glycol, polypropylene glycol, polyoxypropylene alkylamine, a polymer having a $\gamma$-alkyl glutamate residue, spiroacetal diamines, N-(aminoalkyl)-lactams, glycidyl ether-amine adducts, etc.

Thirdly, pressure sensitive manifold papers which give images on a plain paper by transfer are proposed as one type of recording sheets producing images due to a complex formed from a metal compound and a ligand compound in, for example, Japanese Examined Patent Publication No. 16728/1978 and Japanese Unexamined Patent Publication No. 207088/1982. In the above so-called plain paper transfer type pressure sensitive manifold papers, on the recording substrate is formed a transfer layer containing both of the metal compound and the ligand compound in which at least one compound is microencapsulated.

In the above papers, both of the metal compound and the ligand compound are incorporated in the transfer layer. Accordingly, when images are formed on a plain paper by copying, the recording materials remained in the transfer layer react each other to form undesirable images. It is difficult to avoid the above undesirable images, because desensitizers are not yet developed in the chelate type recording materials and the images thus formed have a rather good stability.

We have investigated desensitizers useful for plain paper transfer type pressure sensitive manifold papers employing the PF compound as a metal compound, and found the aforementioned desensitizer of this invention is effective to the chelate type recording materials. With the incorporation of the present desensitizer into the transfer layer or the recording substrate, sharp and stable images are obtained on a plain paper without forming an undesirableimage on the transfer layer.

In a plain paper transfer type pressure sensitive manifold paper in which on a recording substrate is formed a transfer layer having incorporated therein microcapsules containing the PF compound and the ligand compound separately, the above paper is characterized in that the desensitizer of this invention is contained in the transfer layer and/or the recording substrate.

The desensitizer is incorporated into the transfer layer and/or the substrate, when liquid, as it is or in the form of an emulsion, capsule or dispersion having been adsorbed in white pigment, and when solid, in the form of powder as required with pulverized by a ball mill, attritor, sand mill, etc. The desensitizer is generally added to a capsule coating composition and then coated to a substrate to form a transfer layer. Further, the desensitizer is as required mixed with white pigment, binder, etc. and then incorporated into a substrate by a sizepress at paper making or by coating after paper making.

In the above transfer type pressure sensitive manifold papers, one or several (in multicopying) pieces of transfer sheets are superposed on a plain paper. Microcapsules coated on a back side of the sheet rupture with typewriting, etc. and the PF compound and the ligand compound transfer to the opposite side to form images.

The above plain paper is neither coated with the PF compound nor with the ligand compound, but may be coated with an inorganic or organic pigment, etc. at paper making, or by sizepressing, or by coating and the like.

With the encapsulation of both of the ligand compound and the PF compound in the above transfer type manifold papers, the recording materials easily transfer to a plain paper, the ligand compound hardly changes to yellow color with a lapse of time due to air-oxidation, and the coloring of the PF compound is greatly decreased even at a high temperature and humidity. Thus, the transfer layer has an excellent whiteness, and with a conjoint use of the desensitizer, undesirable images are not formed on the transfer layer, whereby manifold papers having a high commercial value are obtained.

Fourthly, as one of leuco type recording materials using a color former and color acceptor, are known self-contained type pressure sensitive manifold papers which further have a microcapsule layer on the reverse side of the paper and are used as a set with the under sheet and/or middle sheet.

In practical use, however, the self-contained type pressure sensitive manifold paper is usually placed on the top of the set, thus the paper is liable to be exposed to air, sunlight, etc., and desensitizing substances such as a plasticizer derived from, e.g. a plastic file, are likely to adhere to the surface of the paper during use or handling thereof. Even a small amount of plasticizer impairs the inherent function of the set by being affected in the color forming ability. Moreover, the resulting images are poor in light-resistance and vary in tone with a lapse of time.

In view of the above, we have investigated and reached to a set of self-contained type pressure sensitive manifold papers which are free from the above disadvantages and have, at the same time, advantages of leuco type recording materials, namely sharpness and brightness of the images and free selection of tone.

The above set comprises a top sheet, and an under sheet and, when desired, one or more middle sheets. The top sheet has one surface of the support having formed thereon self-contained pressure sensitive copy layer comprising chelate type recording materials constituted by the PF compound and the ligand compound, and the other surface thereof coated with microcapsules containing color former or color acceptor. The under sheet has one surface of the support coated with color acceptor (when color former is used in the top sheet) or color former (when color acceptor is used in the top sheet.) The middle sheet has one surface of the support coated with color acceptor and the other surface thereof coated with microcapsules containing color former, when the color former is coated on the reverse side of the top sheet.

This invention will be described below in more detail with reference to Examples and Comparison Examples by no means limited to, in which parts and percentages are all by weight, unless otherwise specified.

(I) EXAMPLES OF RECORDING MATERIALS IN WHICH AN ORGANIC COMPOUND ADHERES TO THE SURFACE OF THE PF COMPOUND

Example 1

Preparation of an under sheet

To 800 parts of 5% aqueous solution of sodium hydroxide were added 89 parts of 4-tert.-butylbenzoic acid, 125 parts of diphenyl phosphate and 70 parts of sodium laurylbenzenesulfonate. An aqueous solution of 108 parts of ferric chloride ($FeCl_3.6H_2O$) in 500 parts of water was added to the solution with vigorous stirring to form a dispersion containing yellow fine particles. To the dispersion was added 500 parts of 20% aqueous solution of sodium 4-tert.-butylbenzoate. Thereto was added gradually 25 parts of titanium tetrachloride with vigorous stirring to obtain a light yellow fine particles dispersion which was filtered and washed with water to prepare a slurry.

In 200 parts of water were dissolved 1 part of sodium polyacrylate and 1 part of hydroxyethyl cellulose. Thereto were added 20 parts (as solids) of the slurry, 20 parts of titanium oxide and 60 parts of calcium carbonate with vigorous stirring to prepare a dispersion. To the dispersion was added 15 parts of carboxyl-modified styrene-butadiene copolymer latex (50% concentration) to obtain a coating composition.

The coating composition was applied by a rod blade coater to a paper substrate weighing 40 g/m$^2$ in an amount of 5 g/m$^2$ by dry weight to prepare an under sheet.

The whiteness of the coated surface of the under sheet was 81% when measured by an electric reflectance photometer (trade name "ELREPHO," product of Carl-Zeiss using a filter of No. 8 grade ).

Preparation of a Microcapsule Dispersion Containing a Ligand Compound and a Top Sheet A 20 part quantity of lauryl gallate was dissolved with heating in a mixture of 50 parts of diethyl adipate and 50 parts of di-n-butyl adipate to obtain an oil. A 20% aqueous solution of sodium hydroxide was added to 150 parts of 3.3% aqueous solution of ethylenemaleic anhydride copolymer (trade name "EMA-31," product of Monsanto Co., Ltd.) to prepare an aqueous solution having a pH of 4.0. To the solution was added the oil and the mixture was emulsified to obtain a dispersion of particles 5 $\mu$ in average size and the resulting dispersion was heated to 60° C.

A 10 part quantity of melamine was added to 30 parts of 37% aqueous solution of formaldehyde and the mixture was reacted at 60° C. for 15 minutes to prepare an aqueous solution of a prepolymer. The prepolymer solution was added dropwise to the above dispersion. Thereafter the system was heated to 70° C. with stirring and maintained at the same temperature for 3 hours and allowed to cool to obtain a milk-white microcapsule dispersion.

A 20 part quantity of wheat starch powder and 20 parts of pulp powder were added to the dispersion. Water was added thereto in such amount as to achieve 25% solids concentration, whereby a capsule-containing coating composition was obtained. The coating composition was applied by an air-knife coater to a paper substrate weighing 40 g/m$^2$ in an amount of 6 g/m$^2$ (as solids) to prepare a top sheet.

The top sheet was superposed on the under sheet with the coatings facing each other and sharp images were formed on the under sheet by typewriting having a color density of 0.95 one hour after the typewriting measured by the Macbeth densitometer (Model RD-100R, product of Macbeth Corp., with use of an amber filter).

COMPARISON EXAMPLE 1

Preparation of an Under Sheet

To 800 parts of 5% aqueous solution of sodium hydroxide were added 89 parts of 4-tert.-butylbenzoic acid, 125 parts of diphenyl phosphate and 70 parts of sodium laurylbenzenesulfonate. An aqueous solution of 108 parts of ferric chloride in 500 parts of water was added to the solution with vigorous stirring to form a dispersion containing yellow fine particles. The dispersion was filtered off and was washed with water to obtain a slurry.

In 200 parts of water were dissolved 1 part of sodium polyacrylate and 1 part of hydroxyethyl cellulose. Thereto were added 10 parts (as solids) of the slurry, 30 parts of titanium oxide and 60 parts of calcium carbonate with vigorous stirring to prepare a dispersion. To the dispersion was added 15 parts of carboxyl-modified styrene-butadiene copolymer latex (50% concentration) to obtain a coating composition.

The coating composition was applied by a rod blade coater to a paper substrate weighing 40 g/m$^2$ in an amount of 5 g/m$^2$ by dry weight to obtain an under sheet.

The whiteness of the coated surface of the under sheet was 74% which was considerably low compared with Example 1.

A top sheet prepared in the same manner as in Example 1 was superposed on the under sheet thus obtained with the coatings facing each other. The sharp images having a color density of 0.92 were formed on the under sheet by typewriting.

EXAMPLE 2

In 1000 parts of water were dispersed 79 parts of phenyl phosphonic acid and 96 parts of 4-n-pentylbenzoic acid. To the dispersion was added 10% aqueous solution of potassium hydroxide with stirring to prepare an aqueous solution having a final pH of 10.0. An aqueous solution of 135 parts of ferric chloride in 500 parts of water was added to the solution with vigorous stirring to form a dispersion containing yellow fine particles. To the dispersion was added an aqueous solution of 50 parts of sodium 4-tert.-butylbenzoate and 136 parts of sodium diphenylphosphate in 1000 parts of water. A 38 part quantity of titanium tetrachloride was gradually added to the dispersion with vigorous stirring to prepare a light yellow fine particles dispersion which was filtered and washed with water to obtain a slurry.

An under sheet was prepared in the same manner as in Example 1 with the exception of using 20 parts (as solids) of the slurry. The whiteness of the under sheet was 82% when measured by the electric reflectance photometer. A top sheet prepared in the same manner as in Example 1 was superposed on the under sheet. Sharp images were formed on the under sheet by typewriting in the same manner as in Example 1.

COMPARISON EXAMPLE 2

In 1000 parts of water were dispersed 79 parts of phenyl phosphonic acid and 96 parts of 4-n-penthylbenzoic acid. To the dispersion was added 10% aqueous solution of potassium hydroxide with stirring to prepare an aqueous solution having a final pH of 10.0. An aqueous solution of 135 parts of ferric chloride in 500 parts of water was added to the solution with vigorous stirring to form a dispersion containing yellow fine particles. The dispersion was filtered and washed with water to obtain a slurry.

An under sheet was prepared in the same manner as in Comparison Example 1 with the exception of using 10 parts (as solids) of the slurry. The whiteness of the under sheet was 75% which was considerably low compared with Example 2 when measured by the electric reflectance photometer. A top sheet prepared in the same manner as in Example 1 was superposed on the under sheet. Sharp images were formed on the under sheet by typewriting in the same manner as in Example 2.

EXAMPLE 3

In 800 parts of 5% aqueous solution of sodium hydroxide were added 61 parts of benzoic acid and 117 parts of diphenyl phosphite. An aqueous solution of 72 parts of ferric chloride, 6.8 parts of zinc chloride ($ZnCl_2$) and 100 parts of 1N-aqueous solution of hydrochloric acid in 500 parts of water was added to the solution with vigorous stirring to form a dispersion containing yellow fine particles. An aqueous solution of 50 parts of sodium 4-tert.-butylbenzoate, 136 parts of sodium diphenylphosphate and 87 parts of sodium laurylbenzenesulfonate in 1000 parts of water was added to the dispersion. Thereto was added gradually an aqueous solution of 41 parts of $ZnCl_2$, 13.3 parts of $AlCl_3$ and 100 parts of 1N-aqueous solution of hydrochloric acid in 500 parts of water with vigorous stirring to obtain a light yellow fine particles dispersion which was filtered and washed with water to prepare a slurry.

An under sheet was prepared in the same manner as in Example 1 with the exception of using 20 parts (as solids) of the slurry. The whiteness of the under sheet was 82% when measured by the electric reflectance photometer. A top sheet prepared in the same manner as in Example 1 was superposed on the under sheet. Sharp images were formed on the under sheet by typewriting in the same manner as in Example 1.

COMPARISON EXAMPLE 3

In 800 parts of 5% aqueous solution of sodium hydroxide were added 61 parts of benzoic acid and 117 parts of diphenyl phosphite. An aqueous solution of 72 parts of ferric chloride, 6.8 parts of zinc chloride ($ZnCl_2$) and 100 parts of 1N-aqueous solution of hydrochloric acid in 500 parts of water was added to the solution with vigorous stirring to form a dispersion containing yellow fine particles. The dispersion was filtered and washed with water to obtain a slurry.

An under sheet was prepared in the same manner as in Comparison Example 1 with the exception of using 10 parts (as solids) of the slurry. The whiteness of the under sheet was 76% which was considerably low compared with Example 3 when measured by the electric reflectance photometer. A top sheet prepared in the same manner as in Example 1 was superposed on the under sheet. Sharp images were formed on the under sheet by typewriting in the same manner as in Example 3.

EXAMPLE 4

To 1200 parts of 5% aqueous solution of sodium hydroxide were added 178 parts of 4-tert.-butylbenzoic acid and 201 parts of di(p-biphenylyl)phosphate. An aqueous solution of 72 parts of ferric chloride and 12.7 parts of ferrous chloride ($FeCl_2$) in 500 parts of water was added to the solution with vigorous stirring to form a dispersion containing yellow-brown fine particles. An aqueous solution of 35 parts of $NiCl_2$ in 500 parts of water was added to the dispersion with vigorous stirring to prepare a light yellow fine particles dispersion which was filtered and washed with water to obtain a slurry.

An under sheet was prepared in the same manner as in Example 1 with the exception of using 20 parts (as solids) of the slurry. The whiteness of the under sheet was 81% when measured by the electric reflectance photometer.

Preparation of a Microcapsule Dispersion Containing a Ligand Compound and a Top Sheet A 10 part quantity of lauryl gallate, 3 parts of N,N'-dibenzyl dithiooxyamide and 2 parts of 1,10-phenanthroline were dissolved with heating in a mixture of 30 parts of diethyl adipate and 70 parts of di-n-butyl adipate to obtain an oil. A top sheet was prepared in the same manner as in Example 1 with the exception of using the oil.

The top sheet was superposed on the under sheet obtained in the above and sharp images were formed on the under sheet by typewriting.

EXAMPLE 5

To 1200 parts of 5% aqueous solution of sodium hydroxide were added 302 parts of di(p-biphenylyl) phosphate and 129 parts of 1-naphthoic acid. An aqueous solution of 135 parts of ferric chloride in 1000 parts of water was added to the solution with vigorous stirring to form a dispersion containing yellow fine particles. To the dispersion was added 850 parts of 20% aqueous solution of sodium salt of di(p-biphenylyl)phosphate. A 20 part quantity of titanium tetrachloride was gradually added to the dispersion with vigorous stirring to prepare a light yellow fine particles dispersion which was filtered and washed with water to obtain a slurry.

An under sheet was prepared in the same manner as in Example 1 with the exception of using 20 parts (as solids) of the slurry. The whiteness of the under sheet was 81% when measured by the electric reflectance photometer. A top sheet prepared in the same manner as in Example 1 was superposed on the under sheet. Sharp images were formed on the under sheet by typewriting in the same manner as in Example 1.

EXAMPLE 6

To 800 parts of 5% aqueous solution of sodium hydroxide was added 250 parts of diphenyl phosphate. An aqueous solution of 90 parts of ferric chloride in 500 parts of water was added to the solution with vigorous stirring to form a dispersion containing light yellow fine particles. To the dispersion was added 485 parts of 20% aqueous solution of sodium salt of 1-naphthoic acid. A 24 part quantity of titanium tetrachloride was gradually added to the dispersion with vigorous stirring to prepare a white fine particles dispersion which was filtered and washed with water to obtain a slurry.

An under sheet was prepared in the same manner as in Example 1 with the exception of using 20 parts (as solids) of the slurry. The whiteness of the under sheet was 84% when measured by the electric reflectance photometer. A top sheet prepared in the same manner as in Example 1 was superposed on the under sheet. Sharp images were formed on the under sheet by typewriting.

EXAMPLE 7

To 1200 parts of 5% aqueous solution of sodium hydroxide were added 242 parts of di(n-octyl)phosphate and 104 parts of thiobenzoic acid. An aqueous solution of 90 parts of ferric chloride in 1000 parts of water was added to the solution with vigorous stirring to form a dispersion containing yellow fine particles. To the dispersion was added gradually 25 parts of titanium tetrachloride to prepare a light yellow fine particles dispersion which was filtered and washed with water to obtain a slurry.

An under sheet was prepared in the same manner as in Example 1 with the exception of using 20 parts (as solids) of the slurry. The whiteness of the under sheet was 80% when measured by the electric reflectance photometer. A top sheet prepared in the same manner as in Example 1 was superposed on the under sheet. Sharp images were formed on the under sheet by typewriting in the same manner as in Example 1.

EXAMPLE 8

To 1200 parts of 5% aqueous solution of sodium hydroxide were added 236 parts of diphenyl thiophosphate, 134 parts of 4-tert.-butylbenzoic acid and 70 parts of sodium laurylbenzenesulfonate. An aqueous solution of 108 parts of ferric chloride in 1000 parts of water was added to the solution with vigorous stirring to form a dispersion containing yellow fine particles. To the dispersion was added gradually 25 parts of titanium tetrachloride to prepare a light yellow fine particles dispersion which was filtered and washed with water to obtain a slurry.

An under sheet was prepared in the same manner as in Example 1 with the exception of using 20 parts (as solids) of the slurry. The whiteness of the under sheet was 81%. A top sheet prepared in the same manner as in Example 1 was superposed on the under sheet. Sharp images were formed on the under sheet by typewriting in the same manner as in Example 1.

EXAMPLE 9

To 1200 parts of 5% aqueous solution of sodium hydroxide were added 188 parts of diphenyl phosphate and 134 parts of 4-tert.-butylbenzoic acid. An aqueous solution of 90 parts of ferric chloride in 1000 parts of water was added to the solution with vigorous stirring to form a dispersion containing yellow fine particles. To the dispersion was added gradually 500 parts of 1N-aqueous solution of hydrochloric acid to prepare a light yellow fine particles dispersion which was filtered and washed with water to obtain a slurry.

An under sheet was prepared in the same manner as in Example 1 with the exception of using 20 parts (as solids) of the slurry. The whiteness of the under sheet was 82%. A top sheet prepared in the same manner as in Example 1 was superposed on the under sheet. Sharp images were formed on the under sheet by typewriting in the same manner as in Example 1.

EXAMPLE 10

To 1200 parts of 5% aqueous solution of sodium hydroxide was added 109 parts of (2-carboxy)phenyl phosphate. An aqueous solution of 90 parts of ferric chloride in 1000 parts of water was added to the solution with vigorous stirring to form a dispersion containing yellow fine particles. To the dispersion was added gradually 25 parts of titanium tetrachloride to prepare a light yellow fine particles dispersion which was filtered and washed with water to obtain a slurry.

An under sheet was prepared in the same manner as in Example 1 with the exception of using 15 parts (as solids) of the slurry. The whiteness of the under sheet was 80%. A top sheet prepared in the same manner as in Example 1 was superposed on the under sheet. Sharp images were formed on the under sheet by typewriting in the same manner as in Example 1.

Examples 11 TO 21

Eleven kinds of slurries having dispersed therein light yellow fine particles were prepared in the same manner as in Example 7 except that organic phosphorus compounds and carboxylic acids as shown in Table 1 were used in an amount of parts indicated therein in place of 242 parts of di(n-octyl)phosphate and 104 parts of thiobenzoic acid.

Eleven kinds of under sheets were prepared in the same manner as in Example 1 with the exception of using 20 parts (as solids) of the above slurries respectively. The whiteness of the under sheets was measured with the results shown in Table 1. A top sheet prepared in the same manner as in Example 1 was superposed on each of 11 kinds of the under sheets. Sharp images were formed on each of the under sheet by typewriting.

TABLE 1

| Example No. | Organic phosphorus compound: Formula | Organic phosphorus compound: R | Carboxylic acid | A/B* (parts by weight) | Whiteness |
|---|---|---|---|---|---|
| 11 | 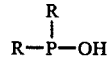 | Phenyl | (a) | 152/134 | 80 |
| 12 | 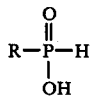 | 2-(2'-hydroxy phenyl)-phenyl | (b) | 176/176 | 81 |
| 13 | 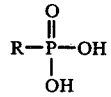 | Phenyl | (c) | 59/144 | 82 |
| 14 | 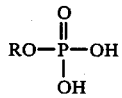 | Phenyl | (a) | 65/134 | 81 |
| 15 | 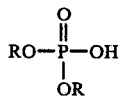 | 4-methylphenyl | (a) | 209/134 | 80 |
| 16 | 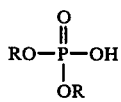 | 4-chlorophenyl | (a) | 239/134 | 82 |

TABLE 1-continued

| Example No. | Organic phosphorus compound: Formula | Organic phosphorus compound: R | Carboxylic acid | A/B* (parts by weight) | Whiteness |
|---|---|---|---|---|---|
| 17 | $R-\overset{\overset{O}{\|}}{P}(OR)-OH$ | Phenyl | (a) | 176/134 | 80 |
| 18 | $R-\overset{\overset{O}{\|}}{P}(R)-OH$ | Phenyl | (a) | 164/134 | 81 |
| 19 | $RO-\overset{\overset{O}{\|}}{P}(OH)-O-\overset{\overset{O}{\|}}{P}(OH)-OR$ | Phenyl | (a) | 124/134 | 79 |
| 20 | $R_1COO-\overset{\overset{O}{\|}}{P}(OH)-OR_2$ | $R_1$ = Propyl<br>$R_2$ = Phenyl | (a) | 183/134 | 81 |
| 21 | $R_1O-\overset{\overset{O}{\|}}{P}(OH)-NHR_2$ | $R_1$ = Phenyl<br>$R_2$ = Benzyl | (a) | 197/134 | 80 |

*A = Organic phosphorus compound,
B = Carboxylic acid,
(a) = 4-tert-butyl-benzoic acid,
(b) = 4-n-octyl-benzoic acid,
(c) = 4-n-pentyl-benzoic acid

(II) EXAMPLES OF RECORDING MATERIALS CONTAINING AN ORGANIC BASE

EXAMPLE 22

Preparation of a Top Sheet

To a vessel equipped with a heater and stirrer was added 150 parts of 3.3% aqueous solution of ethylenemaleic anhydride copolymer (trade name "EMA-31," product of Monsanto Co., Ltd.). Thereto was added 20% aqueous solution of sodium hydroxide to adjust a pH to 4.0 to obtain an aqueous medium for preparing microcapsules.

In a solvent mixture of 70 parts of di-n-butyl adipate and 30 parts of diethyl adipate were dissolved 15 parts of lauryl gallate and 3 parts of dibenzylamine to prepare a capsule core material.

The core material was dispersed in the above aqueous medium to obtain an emulsion containing particles 5.0μ in average size and the emulsion was heated to 60° C.

A 10 part quantity of melamine was added to 30 parts of 37% aqueous solution of formaldehyde and the mixture was reacted at 60° C. for 15 minutes to prepare an aqueous solution of a prepolymer. The prepolymer solution was added dropwise to the above emulsion. Thereafter the system was heated to 70° C. with mild stirring and maintained at the same temperature for 3 hours and allowed to cool to obtain a milk-white microcapsule dispersion.

A 20 part quantity of wheat starch powder and 10 parts of pulp powder were added to the dispersion. Water was added thereto in such amount as to achieve 25% solids concentration, whereby a capsule-containing coating composition was obtained. The coating composition was applied by an air-knife coater to a paper substrate weighing 40 g/m$^2$ in an amount of 5 g/m$^2$ (as solids) to prepare a top sheet.

Preparation of an Under Sheet

To 800 parts of 5% aqueous solution of sodium hydroxide was added 250 parts of diphenyl phosphate. An aqueous solution of 90 parts of ferric chloride ($FeCl_3 \cdot 6H_2O$) in 500 parts of water was added to the solution with stirring to precipitate iron salt of diphenyl phosphate. The precipitate was filtered off and was washed with water and dried to obtain a light yellow fine powder.

In 250 parts of water were dissolved 1 part of sodium polystyrenesulfonate and 1 part of polyvinyl alcohol as dispersing agents. Thereto were added 20 parts of the fine powder, 30 parts of zine oxide, 50 parts of calcium carbonate. The mixture was pulverized by a sand mill. To the resulting dispersion was added 15 parts of styrene-butadiene copolymer latex (50% concentration) to prepare a coating composition.

The coating composition was applied by a blade coater to a paper substrate weighing 40 g/m$^2$ in an amount of 5 g/m$^2$ by dry weight to obtain a virtually colorless under sheet.

The whiteness of the coated surface of the under sheet was 78% when measured by an electric reflectance photometer (trade name "ELREPHO," product of Carl-Zeiss using a filter of No. 8 grade ).

The top sheet was superposed on the under sheet with the coatings facing each other and images were formed on the under sheet by typewriting. The color density of the images after 10 seconds from the typewriting (hereinafter referred to as "initial color density") and that with a lapse of 1 hour (hereinafter referred to as "final color density") were measured by the Macbeth densitometer (Model RD-100R, product of Macbeth Corp., with use of an amber filter). The results were given in Table 2.

COMPARISON EXAMPLE 4

A top sheet was prepared in the same manner as in Example 22 except that dibenzylamine was not used.

The top sheet was superposed on an under sheet prepared in the same manner as in Example 22 and the initial and final color densities were measured in the same method as in Example 22. The results were shown in Table 2.

EXAMPLE 23

Preparation of a Top Sheet

To a vessel equipped with a heater and stirrer was added 30 parts of 3.3% aqueous solution of ethylenemaleic anhydride copolymer (trade name "EMA-31," product of Monsanto Co., Ltd.). Thereto was added 20% aqueous solution of sodium hydroxide to adjust a pH to 4.0 to obtain an aqueous medium for preparing microcapsules.

In a solvent mixture of 14 parts of di-n-butyl adipate and 6 parts of diethyl adipate were dissolved 1.8 parts of dibenzylamine to prepare a capsule core material.

The core material was dispersed in the above aqueous medium to obtain an emulsion containing particles 7.0μ in average size and the emulsion was heated to 60° C.

A 2 part quantity of melamine was added to 6 parts of 37% aqueous solution of formaldehyde and the mixture was reacted at 60° C. for 15 minutes to prepare an aqueous solution of a prepolymer. The prepolymer solution was added dropwise to the above emulsion. Thereafter the system was heated to 70° C. with mild stirring and maintained at the same temperature for 3 hours and allowed to cool to obtain a milk-white microcapsule dispersion.

The microcapsule dispersion thus obtained containing dibenzylamine was mixed with a microcapsule dispersion prepared in the same manner as in Comparison Example 4 containing lauryl gallate. To the mixed dispersion were added 22 parts of wheat starch powder and 11 parts of pulp powder. Water was added thereto in such amount as to achieve 25% solids concentration, whereby a capsule-containing coating composition was obtained. The coating composition was applied by an air knife coater to a paper substrate weighing 40 g/m$^2$ in an amount of 6 g/m$^2$ (as solids) to prepare a top sheet.

Preparation of an Under Sheet

To 1200 parts of 5% aqueous solution of sodium hydroxide were added 188 parts of diphenyl phosphate and 134 parts of 4-tert.-butylbenzoic acid. An aqueous solution of 135 parts of ferric chloride in 1000 parts of water was added to the solution with stirring to precipitate two-component composite salt of diphenyl phosphate and 4-tert.-butylbenzoic acid. The precipitate was filtered off and was washed with water and dried to obtain a yellow fine powder.

In 250 parts of water were dissolved 1 part of sodium alkylnaphthalenesulfonate and 1 part of polyvinyl alcohol as dispersing agents. Thereto were added 20 parts of the fine powder, 30 parts of zine oxide and 50 parts of calcium carbonate. The mixture was pulverized by a sand mill. To the resulting dispersion was added 15 parts of styrene-butadiene copolymer latex (50% concentration) to prepare a coating composition.

The coating composition was applied by an air knife coater to a paper substrate weighing 40 g/m$^2$ in an amount of 5 g/m$^2$ by dry weight to obtain an under sheet having a whiteness of 75%.

The top sheet was superposed on the under sheet and the initial and final color densities were measured in the same manner as in Example 22. The results were shown in Table 2.

EXAMPLE 24

A microcapsule dispersion prepared in the same manner as in Example 22 and containing lauryl gallate and dibenzylamine was mixed with a microcapsule dispersion obtained in the same manner as in Example 23 and containing dibenzylamine. To the mixed dispersion were added 22 parts of wheat starch powder and 11 parts of pulp powder. Water was added thereto in such amount as to achieve 25% solid concentration, whereby a capsule-containing coating composition was obtained. The coating composition was applied by an air knife coater to a paper substrate weighing 40 g/m$^2$ in an amount of 6 g/m$^2$ (as solids) to prepare a top sheet.

The top sheet was superposed on an under sheet prepared in the same manner as in Example 23 and the initial and final color densities were measured in the same manner as in Example 23 with the results given in Table 2.

EXAMPLE 25

A top sheet obtained in the same manner as in Example 22 was superposed on an under sheet prepared in the same manner as in Example 23. The initial and final color densities were measured in the same manner as in Example 23 with the results given in Table 2.

COMPARISON EXAMPLE 5

A pressure sensitive manifold paper was prepared in the same manner as in Example 23 with the exception of using a top sheet obtained in the same manner as in Comparison Example 4. The color densities were measured with the results shown in Table 2.

EXAMPLES 26 TO 29

Four kinds of microcapsule dispersions containing an organic base were prepared in the same manner as in Example 23 except that, in place of 1.8 parts of dibenzylamine, 3 parts of mesidine (Example 26), 5 parts of tribenzylamine (Example 27), 5 parts of N,N-dimethylbenzylamine (Example 28) and 5 parts of 1,2,3,4-tetrahydroquinoline (Example 29) were used respectively. Four kinds of top sheets were prepared in the same manner as in Example 23 with the exception of using above microcapsule dispersions in place of that of Example 23.

Each of 4 kinds of top sheets was superposed on an under sheet obtained in the same manner as in Example 23 and the color densities were measured with the results given in Table 2.

EXAMPLE 30

Preparation of a Top Sheet

To a vessel equipped with a heater and stirrer was added 15 parts of 3.3% aqueous solution of ethylenemaleic anhydride copolymer (trade name "EMA-31," product of Monsanto Co., Ltd.). Thereto was added 20% aqueous solution of sodium hydroxide to adjust a pH to 4.0 to obtain an aqueous medium for preparing microcapsules.

A 5 part quantity of tri-n-octylamine was dispersed in the above aqueous medium to obtain an emulsion containing particles 7.0μ in average size and the emulsion was heated to 60° C.

A 0.5 part quantity of melamine was added to 1.5 parts of 37% aqueous solution of formaldehyde and the mixture was reacted at 60° C. for 15 minutes to prepare an aqueous solution of a prepolymer. The prepolymer solution was added dropwise to the above emulsion. Thereafter the system was heated to 70° C. with mild stirring and maintained at the same temperature for 3 hours and allowed to cool to obtain a milk-white microcapsule dispersion.

A top sheet was prepared in the same manner as in Example 23 except that the microcapsule dispersion containing tri-n-octylamine was used in place of that containing dibenzylamine.

The top sheet was superposed on an under sheet prepared in the same manner as in Example 23 and the color densities were measured with the results shown in Table 2.

EXAMPLE 31

Preparation of an Under Sheet

To 800 parts of 5% aqueous solution of sodium hydroxide were added 89 parts of 4-tert.-butylbenzoic acid, 125 parts of diphenyl phosphate and 70 parts of sodium laurylbenzenesulfonate. An aqueous solution of 108 parts of ferric chloride in 500 parts of water was added to the solution with vigorous stirring to form a dispersion containing yellow fine particles of three-component composite salt. The dispersion was filtered off and was washed with water to obtain a slurry.

In 200 parts of water were dissolved 1 part of sodium polyacrylate and 1 part of hydroxyethyl cellulose. Thereto were added 20 parts (as solids) of the slurry, 40 parts of titanium oxide and 40 parts of calcium carbonate with vigorous stirring to prepare a dispersion. To the dispersion was added 15 parts of carboxyl-modified styrene-butadiene copolymer latex (50% concentration) to obtain a coating composition.

The coating composition was applied by a rod blade coater to a paper substrate weighing 40 g/m$^2$ in an amount of 5 g/m$^2$ by dry weight to obtain an under sheet having a whiteness of 77%.

A top sheet obtained in the same manner as in Example 22 was superposed on the under sheet and the color densities were measured with the results shown in Table 2.

EXAMPLE 32

Preparation of an Under Sheet

To 800 parts of 5% aqueous solution of sodium hydroxide were added 89 parts of 4-tert.-butylbenzoic acid, 125 parts of diphenyl phosphate and 70 parts of sodium laurylbenzenesulfonate. An aqueous solution of 108 parts of ferric chloride in 500 parts of water was added to the solution with vigorous stirring to form a dispersion containing yellow fine particles of three-component composite salt. To the dispersion was added 500 parts of 20% aqueous solution of sodium 4-tert.-butylbenzoate. A 25 part quantity of titanium tetrachloride was gradually added thereto with vigorous stirring to obtain a light yellow fine particles dispersion. The dispersion was filtered off and was washed with water to obtain a slurry.

In 200 parts of water were dissolved 1 part of sodium polyacrylate and 1 part of hydroxyethyl cellulose. Thereto were added 20 parts (as solids) of the slurry, 40 parts of titanium oxide and 40 parts of calcium carbonate with vigorous stirring to prepare a dispersion. To the dispersion was added 15 parts of carboxyl-modified styrene-butadiene copolymer latex (50% concentration) to obtain a coating composition.

The coating composition was applied by a rod blade coater to a paper substrate weighing 40 g/m$^2$ in an amount of 5 g/m$^2$ by dry weight to obtain an under sheet having a whiteness of 80%.

The color densities were measured in the same manner as in Example 31 with the exception of using the above under sheet with the results given in Table 2.

EXAMPLE 33

A coating composition containing an iron compound obtained in the same manner as in the preparation of the under sheet of Example 23 was mixed with a microcapsule dispersion containing dibenzylamine obtained in the same manner as in the preparation of the top sheet of Example 23 to prepare a coating composition. The coating composition was applied by air knife coater to a paper substrate weighing 40 g/m$^2$ in an amount of 5.8 g/m$^2$ by dry weight to obtain an under sheet having a whiteness of 76%.

A top sheet prepared in the same manner as in Comparison Example 4 was superposed on the under sheet and the color densities were measured with the results given in Table 2.

EXAMPLE 34

In 200 parts of methanol were dissolved 26.6 parts of di(2,4-di-α-methylbenzylphenyl)phosphate and 7.1 parts of 4-tert.-butylbenzoic acid. A 4.5 part quantity of potassium hydroxide was dissolved in the solution to form a potassium salt of the organic acid. Thereto were added 90 parts of di-n-butyl adipate and 10 parts of diisopropylnaphthalene. A solution of 7.2 parts of ferric chloride in 100 parts of methanol was added to the above solution with stirring to form two-component composite salt. Thereto are added 30 parts of sodium sulfate and the mixture was filtered after one hour. A yellow oil was obtained by a distillation of methanol.

To a vessel equipped with a heater and stirrer was added 150 parts of 3.3% aqueous solution of ethylenemaleic anhydride copolymer (trade name "EMA-31," product of Monsanto Co., Ltd.). Thereto was added 20% aqueous solution of sodium hydroxide to adjust a pH to 4.0 to obtain an aqueous medium for preparing microcapsules.

A 100 part quantity of the above oil was dispersed in the above aqueous medium to obtain an emulsion containing particles 6.0μ in average size and the emulsion was heated to 60° C.

A 10 part quantity of melamine was added to 30 parts of 37% aqueous solution of formaldehyde and the mixture was reacted at 60° C. for 15 minutes to prepare an aqueous solution of a prepolymer. The prepolymer solution was added dropwise to the above emulsion. Thereafter the system was heated to 70° C. with mild stirring and maintained at the same temperature for 3 hours and allowed to cool to obtain a light yellow microcapsule dispersion.

The microcapsule dispersion thus obtained containing the iron compound was mixed with a microcapsule dispersion containing dibenzylamine prepared in the same manner as in Example 23. To the mixed dispersion were added 20 parts of wheat starch powder and 10 parts of pulp powder. Water was added thereto in such amount as to achieve 25% solid concentration, whereby a capsule-containing coating composition was obtained. The coating composition was applied by air knife coater to a paper substrate weighing 40 g/m$^2$ in an amount of 6 g/m$^2$ (as solids) to prepare a top sheet.

Preparation of an under sheet

In 250 parts of water were dissolved 1 part of sodium polystyrenesulfonate, 1 part of polyvinyl alcohol and 1 part of citric acid. To the solution were added 30 parts of lauryl gallate, 30 parts of zinc oxide and 40 parts of aluminum hydroxide. The mixture was pulverized by a sand mill. To the resulting dispersion was added 15 parts of styrene-butadiene copolymer latex (50% concentration) to obtain a coating composition.

The coating composition was applied by blade coater to a paper substrate weighing 40 g/m$^2$ in an amount of 5 g/m$^2$ by dry weight to prepare an under sheet.

The top sheet was superposed on the under sheet and the color densities were measured with the results given in Table 2.

COMPARISON EXAMPLE 6

A capsule coating composition was prepared in the same manner as in the preparation of the top sheet of Example 34 except that a microcapsule dispersion containing dibenzylamine was ndt used. The coating composition was applied by air knife coater to a paper substrate weighing 40 g/m$^2$ in an amount of 5 g/m$^2$ (as solids) to prepare a top sheet.

The color densities were measured in the same manner as in Example 34 with the exception of using the top sheet with the results shown in Table 2.

TABLE 2

| | Initial Color Density | Final Color Density |
|---|---|---|
| Ex. 22 | 0.76 | 0.95 |
| Com. Ex. 4 | 0.35 | 0.72 |
| Ex. 23 | 0.89 | 1.02 |
| 24 | 0.97 | 1.12 |
| 25 | 0.93 | 1.06 |
| Com. Ex. 5 | 0.52 | 0.80 |
| Ex. 26 | 0.90 | 1.03 |
| 27 | 0.90 | 1.05 |
| 28 | 0.88 | 1.02 |
| 29 | 0.93 | 1.07 |
| 30 | 0.87 | 1.03 |
| 31 | 0.94 | 1.05 |
| 32 | 0.93 | 1.07 |
| 33 | 0.89 | 1.03 |
| 34 | 0.87 | 1.03 |
| Com. Ex. 6 | 0.53 | 0.79 |

As apparent from Table 2, pressure sensitive manifold papers using the recording materials of the invention are extremely improved in the initial and final color densities.

EXAMPLE 35

A microcapsule dispersion containing dibenzylamine and a coating composition containing a two-component composite salt which were obtained in the same manner as in the preparation of the top sheet and the under sheet of Example 23 respectively were mixed together to prepare a coating composition.

The coating composition was applied by air knife coater to a capsule-coating surface of a top sheet prepared in the same manner as in Comparison Example 4 in an amount of 6 g/m$^2$ (as solids) to obtain a self-contained type pressure sensitive manifold paper.

An uncoated paper was superposed on the self-contained type pressure sensitive manifold paper and images were formed by typewriting. The color density of the images after 10 seconds from the typewriting (hereinafter referred to as "initial color density") and that with a lapse of 1 hour (hereinafter referred to as "final color density") were measured by the Macbeth densitometer (Model RD-100R, product of Macbeth Corp., with use of an amber filter). The results were given in Table 3.

EXAMPLE 36

A coating composition containing a two-component composite salt obtained in the same manner as in the preparation of the under sheet of Example 23 was applied by air knife coater to a capsule-coating surface of a top sheet prepared in the same manner as in Example 22 in an amount of 6 g/m$^2$ (as solids) to prepare a self-contained type pressure sensitive manifold paper.

Images were formed in the same manner as in Example 35 and the results thereof were shown in Table 3.

COMPARISON EXAMPLE 7

A coating composition containing a two-component composite salt obtained in the same manner as in the preparation of the under sheet of Example 23 was applied by air knife coater to a capsule-coating surface of a top sheet prepared in the same manner as in Comparison Example 4 in an amount of 5 g/m$^2$ (as solids) to prepare a self-contained type pressure sensitive manifold paper.

Images were formed in the same manner as in Example 35 and the results thereof were shown in Table 3.

EXAMPLE 37

A microcapsule dispersion containing dibenzylamine and a coating composition containing a two-component composite salt which were obtained in the same manner as in the preparation of the top sheet and the under sheet of Example 23 respectively, and a microcapsule dispersion containing a ligand compound obtained in the same manner as in the preparation of the top sheet of Comparison Example 4 were mixed together to prepare a coating composition. The coating composition was applied by air knife coater to a paper substrate weighing 40 g/m$^2$ in an amount of 10 g/m$^2$ (as solids) to prepare a self-contained type pressure sensitive manifold paper.

Images were formed in the same manner as in Example 35 and the results thereof were given in Table 3.

COMPARISON EXAMPLE 8

A self-contained type pressure sensitive manifold paper was prepared in the same manner as in Example 37 except that the microcapsule dispersion containing dibenzylamine is not used.

Images were formed in the same manner as in Example 35 and the results thereof were shown in Table 3.

TABLE 3

| | Initial Color Density | Final Color Density |
|---|---|---|
| Ex. 35 | 0.90 | 1.05 |
| 36 | 0.87 | 1.03 |
| Com. Ex. 7 | 0.60 | 0.82 |
| Ex. 37 | 0.79 | 0.92 |
| Com. Ex. 8 | 0.52 | 0.71 |

As shown in Table 3, self-contained type pressure sensitive manifold papers employing the recording materials of the invention are extremely improved in the initial and final color densities.

EXAMPLE 38

To 1600 parts of 2.5% aqueous solution of sodium hydroxide maintained at 60° C. was added 603 parts of distearyl phosphate. An aqueous solution of 100 parts of ferric chloride in 1000 parts of water was added to the solution with stirring to form a dispersion containing an iron salt. The dispersion was filtered off and was washed with water to obtain a light yellow slurry.

To 120 parts of 3% aqueous solution of polyvinyl alcohol maintained at 80° C. was added 30 parts of molten distearylamine at 80° C. The mixture was emulsified by a homogenizer to prepare an emulsion 5μ in average particle size which was allowed to cool to room temperature with stirring, whereby a dispersion containing distearylamine was obtained.

In 120 parts of 3% aqueous solution of polyvinyl alcohol was dispersed 30 parts of lauryl gallate and the mixture was pulverized by a sand mill. To the resulting dispersion were added 30 parts of colloidal silica, 5 parts of ethylenediaminetetraacetic acid, 1 part of citric acid, 30 parts of the above iron salt slurry (as solids), 100 parts of the above distearylamine-containing dispersion and 10 parts of styrene-butadiene copolymer latex (50% concentration) to prepare a coating composition for heat sensitive recording paper.

The coating composition was applied by air knife coater to a paper substrate weighing 40 g/m$^2$ in an amount of 10 g/m$^2$ by dry weight to obtain heat sensitive recording paper. Sharp images were formed on the paper by a heated pen.

EXAMPLE 39

To 200 parts of 1% aqueous solution of polyvinyl alcohol were added 200 parts of cuprous iodide and 5 parts of 10% aqueous solution of sodium sulfite. The mixture was pulverized by a sand mill until particles 2μ in average size were obtained. To the mixture were added 8 parts of polyacrylate emulsion and 20 parts of titanium oxide. The resulting mixture was fully dispersed and applied to a paper substrate weighing 50 g/m$^2$ in amount of 7 g/m$^2$ by dry weight. To the surface thus coated was applied a coating composition for heat sensitive recording paper prepared in the same manner as in Example 38 in an amount of 5 g/m$^2$ by dry weight, whereby a electrothermal recording paper was prepared. Clear images were formed by a cylindrical scanning-type recordind tester with a needle pressure of 10 g and a scanning speed of 630 mm/sec.

(III) EXAMPLES OF DESENSITIZER

EXAMPLES 40 TO 47

Preparation of top sheets (A) and (B)

Two kinds of top sheets were prepared in the same manner as in Example 23 and Example 1, which were referred to as "top sheet (A)" and "top sheet (B)" respectively.

Preparation of under sheets (A) and (B)

Two kinds of under sheets were prepared in the same manner as in Example 23 and Example 1, which were referred to as "under sheet (A)" and "under sheet (B)" respectively.

Preparation of desensitizer-containing ink

A 60 part quantity of desensitizer listed in Table 4 was mixed with 30 parts of rosin-modified maleic acid resin (trade name, Hitalac X24M, a product of Hitachi Chemical Co., Ltd.) as a binder. The mixture was heated to obtain a varnish. To the varnish was mixed 10 parts of titanium oxide by a three-roll mill. Thereto was added 3 parts of polyethylene glycol (average molecular weight 400) to prepare an ink.

The ink was printed in spots on the under sheets (A) and (B) in an amount of 5 g/m$^2$.

Evaluation

The top sheets (A) and (B) were superposed on the under sheets (A) and (B) respectively and the images were formed by a typewriter. The resulting images were checked with an unaided eye both in non-desensitizing and desensitizing portions. The desensitizing effect was given in Table 4. In the Table, O: excellent desensitizing effect Δ: a little inferior compared with O (I): top sheet (A) and under sheet (A) used (II): top sheet (B) and under sheet (B) used

TABLE 4

| Ex. | Desensitizer | Desensitizing Effect (I) | Desensitizing Effect (II) |
|---|---|---|---|
| 40 | Dioctyl phosphate | O | O |
| 41 | Dioctyl phosphate<br>Octyl phosphate | O | O |
| 42 | Dioleyl phosphate | O | O |
| 43 | 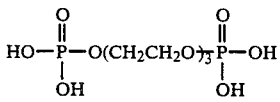 | O | O |
| 44 | 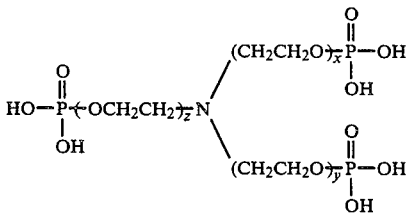 | O | O |

TABLE 4-continued

| Ex. | Desensitizer | Desensitizing Effect (I) | Desensitizing Effect (II) |
|---|---|---|---|
| | Mixture (x + y + z = 3~8) | | |
| 45 | 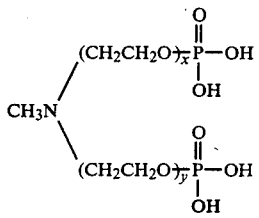 | O | O |
| | Mixture (x + y = 2~8) | | |
| 46 | Glycol ether diaminetetraacetic acid | Δ | Δ |
| 47 | 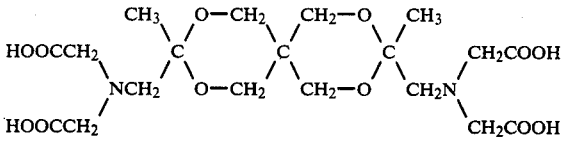 | O | O |

REFERENCE EXAMPLE 1

Desensitizing effects were evaluated in the same manner as in Examples 40 to 47 with the exception of using the top sheet of Example 1 and the under sheet of Comparison Example 1. Excellent desensitizing effects were obtained in the same manner as in Examples 40 to 47.

(IV) EXAMPLES OF SELF-CONTAINED TYPE PRESSURE SENSITIVE MANIFOLD PAPERS CONTAINING OIL-ABSORBING PIGMENT

EXAMPLE 48

Preparation of microcapsules containing the PF compound

A microcapsule dispersion containing the PF compound was prepared in the same manner as in Example 34.

Preparation of microcapsules containing the ligand compound

A microcapsule dispersion containing the ligand compound was prepared in the same manner as in Example 1.

Preparation of microcapsules containing an organic base

A microcapsule dispersion containing dibenzylamine was prepared in the same manner as in Example 23.

Preparation of self-contained type pressure sensitive manifold papers

To a mixture of the above 3 kinds of capsule dispersions were added 1 part of sodium alkylnaphthalenesulfonate, 1 part of ethylenediaminetetraacetic acid, 40 parts of 5% aqueous solution of hydroxyethyl cellulose and 60 parts of pulp powder. Water was added thereto in such amount as to achieve 18% solid concentration, whereby a capsule-containing coating composition was obtained. The coating composition was applied by an air knife coater to a paper substrate weighing 40 g/m$^2$ in an amount of 8 g/m$^2$ (as solids).

In 300 parts of water were dissolved 2 parts of sodium polyacrylate and 1 part of polyvinyl alcohol. Thereto were added 40 parts of titanium oxide and 60 parts of calcium carbonate and the mixture was pulverized by a sand mill. To the resulting dispersion was added 15 parts of styrene-butadiene copolymer latex (50% concentration) to obtain a coating composition.

The coating composition was applied by an air knife coater to the capsule-coated surface of the above paper in an amount of 5 g/m$^2$ (as solids) to prepare a self-contained type pressure sensitive manifold paper having an excellent whiteness.

EXAMPLE 49

A microcapsule dispersion containing the PF compound was mixed with a microcapsule dispersion containing an organic base, both dispersion being prepared in the same manner as in Example 48. To the mixed dispersion were added 0.5 part of sodium alkylnaphthalenesulfonate, 20 parts of 5% aqueous solution of polyvinyl alcohol, 20 parts of pulp powder and 10 parts of starch powder. Water was added thereto in such amount as to achieve 18% solid concentration to obtain a capsule-containing coating composition. The coating composition was applied by an air knife coater to a paper substrate weighing 40 g/m$^2$ in an amount of 5 g/m$^2$ (as solids).

In 300 parts of water were dissolved 2 parts of sodium polyacrylate and 1 part of polyvinyl alcohol. Thereto were added 40 parts (as solids) of a microcapsule dispersion containing the ligand compound prepared in the same manner as in Example 48, 50 parts of calcium carbonate and 10 parts of activated clay with vigorous stirring to obtain a dispersion. To the dispersion was added 8 parts of styrene-butadiene copolymer latex (50% concentration) to prepare a coating composition.

The coating composition was applied by an air knife coater to the capsule-coated surface of the above paper in an amount of 6 g/m$^2$ (as solids) to obtain a self-contained type pressure sensitive manifold paper having an excellent whiteness.

EXAMPLE 50

In 1500 parts of water were dissolved 5 parts of sodium polyacrylate and 5 parts of polyvinyl alcohol. Thereto were added 120 parts of zinc oxide, 40 parts of activated clay and 240 parts of calcium carbonate and the mixture was pulverized by a sand mill. To the resulting dispersion were added 3 kinds of capsule dispersions prepared in the same manner as in Example 48, 60 parts of pulp powder, 1 part of ethylenediaminetetraacetic acid, 1 part of sodium alkylnaphthalenesulfonate and 60 parts of styrene-butadienecopolymer latex (50% concentration) to obtain a coating composition.

The coating composition was applied by an air knife coater to a paper substrate weighing 40 g/m$^2$ in an amount of 10 g/m$^2$ (as solids) to prepare a self-contained type pressure sensitive manifold paper having an excellent whiteness.

COMPARISON EXAMPLE 9

Preparation of microcapsules containing the ligand compound

A 20 part quantity of lauryl gallate was dissolved with heating in a mixture of 50 parts of di-n-butyl adipate and 50 parts of diethyl adipate to obtain an oil. The oil was added to 200 parts of 10% aqueous solution of acid-treated gelatin having an isoelectric point of 8.0 and the mixture was treated by a homogenizer to obtain an emulsion containing particles 5.0$\mu$ in average size. To the emulsion was added 500 parts of 0.5% aqueous solution of carboxymethyl cellulose (average polymerization degree: 160, substitution degree: 0.6) having a temperature of 50° C. The system was adjusted to a pH of 5 with 5% aqueous solution of sodium hydroxide and vigorously stirred until the system was cooled to 10° C. To the system was added 3 parts of 50% aqueous solution of glutaraldehyde and the mixture was adjusted to a pH of 7.0 with 5% aqueous solution of sodium hydroxide. The mixture was stirred for further 5 hours to complete curing of the capsules.

Preparation of microcapsules containing the PF compound

A microcapsule dispersion containing the PF compound and having a gelatin wall was prepared in the same manner as in the above microcapsules containing the ligand compound except that 100 parts of an oil containing the PF compound prepared in the same manner as in Example 48 was used as an oil.

Preparation of self-contained type pressure sensitive manifold papers

A self-contained type pressure sensitive manifold paper was prepared in the same manner as in Example 48 with the exception of using, as capsule dispersions, the above ligand compound-containing and PF compound-containing microcapsule dispersions conjointly with an organic base-containing microcapsule dispersion prepared in the same manner as in Example 48. The capsule coating composition was dark-colored before application to a paper and the resulting paper was rather inferior to the paper of Example 48 in whiteness.

COMPARISON EXAMPLE 10

A self-contained type pressure sensitive manifold paper was prepared in the same manner as in Example 49 with the exception of using, as capsule dispersions, the ligand compound-containing and PF compound-containing microcapsule dispersions of Comparison Example 9 and the organic base-containing microcapsule dispersion of Example 48.

The obtained paper was dark-colored and inferior in whiteness. Further, a great decrease in whiteness was observed when the paper was placed at a temperature of 50° C. and humidity of 90% for one day.

COMPARISON EXAMPLE 11

A self-contained type pressure sensitive manifold paper was prepared in the same manner as in Example 50 with the exception of using, as capsule dispersions, the ligand compound-containing and PF compound-containing microcapsule dispersions of Comparison Example 9 and the organic base-containing microcapsule dispersion of Example 48.

The capsule coating composition was dark-colored before application to a paper and the resulting paper was inferior in whiteness.

EXAMPLE 51

Preparation of microcapsules containing the PF compound

To 1200 parts of 5% aqueous solution of sodium hydroxide were added 188 parts of diphenyl phosphate and 134 parts of 4-tert.-butylbenzoic acid. An aqueous solution of 135 parts of ferric chloride in 1000 parts of water was added to the solution with stirring to precipitate two-component composite salt of diphenyl phosphate and 4-tert.-butylbenzoic acid. The precipitate was filtered off and was washed with water and dried to obtain a yellow fine powder.

A 15 part quantity of the above fine powder was dissolved with heating in 100 parts of diethyl adipate to obtain an oil. A microcapsule dispersion was prepared in the same manner as in the preparation of the PF compound-containing microcapsule dispersion of Example 48 with the exception of using the above oil.

Preparation of self-contained type pressure sensitive manifold papers

The above PF compound-containing microcapsule dispersion was mixed with a microcapsule dispersion containing an organic base prepared in the same manner as in Example 48. To the mixed dispersion were added 0.5 part of sodium alkylnaphthalenesulfonate, 20 parts of 5% aqueous solution of polyvinyl alcohol and 20 parts of pulp powder. Water was added thereto in such amount as to achieve 20% solid concentration to obtain a capsule coating composition. The coating composition was applied by an air knife coater to a paper substrate weighing 40 g/m$^2$ in an amount of 6 g/m$^2$ (as solids).

In 300 parts of water were dissolved 2 parts of sodium polyacrylate and 1 part of polyvinyl alcohol. Thereto were added 40 parts (as solids) of a microcapsule dispersion containing the ligand compound prepared in the same manner as in Example 48, 40 parts of calcium carbonate and 20 parts of titanium oxide with vigorous stirring to obtain a dispersion. To the dispersion was added 8 parts of styrene-butadiene copolymer latex (50% concentration) to prepare a coating composition.

The coating composition was applied by an air knife coater to the capsule-coated surface of the above paper in an amount of 6 g/m$^2$ (as solids) to obtain a self-contained type pressure sensitive manifold paper having an excellent whiteness.

COMPARISON EXAMPLE 12

In 300 parts of water were dissolved 1 part of sodium alkylnaphthalenesulfonate and 1 part of polyvinyl alcohol. Thereto were added 6 parts of lauryl gallate, 2 parts of isoamyl gallate, 61 parts of calcium carbonate and 31 parts of titanium oxide and the mixture was pulverized by a sand mill. To the resulting dispersion were added 13 parts of styrene-butadiene copolymer latex (50% concentration) to obtain a coating composition.

The coating composition was applied by an air knife coater to the surface coated with a capsule coating composition containing the PF compound-containing microcapsules and organic base-containing microcapsules prepared in the same manner as in Example 51 in an amount of 6 g/m$^2$ (as solids) to obtain a self-contained type pressure sensitive manifold paper having an excellent whiteness.

When the above paper and the paper obtained in Example 51 were allowed to place in a room for one month, the former was colored in dark yellow, whereas the latter hardly changed.

COMPARISON EXAMPLE 13

A microcapsule dispersion containing the ligand compound was mixed with a microcapsule dispersion containing the organic base, both dispersions being prepared in the same manner as in Example 48. To the mixed dispersion were added 0.5 part of sodium alkylnaphthalenesulfonate, 20 parts of 5% aqueous solution of polyvinyl alcohol and 20 parts of pulp powder. Water was added thereto in such amount as to achieve 20% solid concentration to obtain a capsule coating composition. The coating composition was applied by an air knife coater to a paper substrate weighing 40 g/m$^2$ in an amount of 6 g/m$^2$ (as solids).

In 300 parts of water were dissolved 1 part of sodium alkylnaphthalenesulfonate and 1 part of polyvinyl alcohol. Thereto were added 15 parts of two-component composite salt powder prepared in the same manner as in Example 51, 57 parts of calcium carbonate and 28 parts of titanium oxide. The mixture was pulverized by a sand mill. To the resulting dispersion was added 13 parts of styrene-butadiene copolymer latex (50% concentration) to obtain a coating composition.

The coating composition was applied by an air knife coater to the capsule-coated surface of the above paper in an amount of 6 g/m$^2$ (as solids) to obtain a self-contained type pressure sensitive manifold paper having an excellent whiteness.

When the above paper and the paper obtained in Example 51 were allowed to place at a high temperature of 50° C. and a humidity of 90% for one day, the former was colored in dark yellow, whereas the latter hardly changed.

EXAMPLE 52

A self-contained type pressure sensitive manifold paper having an excellent whiteness was prepared in the same manner as in Example 49 except that the ligand compound-containing microcapsule dispersion of Comparison Example 9 was used as ligand compound-containing microcapsules.

REFERENCE EXAMPLE 2

A self-contained type pressure sensitive manifold paper having an excellent whiteness was prepared in the same manner as in Example 48 except that the organic base-containing microcapsule dispersion was not used.

REFERENCE EXAMPLE 3

A self-contained type pressure sensitive manifold paper having an excellent whiteness was prepared in the same manner as in Example 50 except that the organic base-containing microcapsule dispersion was not used.

Evaluation Test

The above self-contained type pressure sensitive manifold papers were examined in whiteness with (a) no treatment, (b) treatment of placement in a room for one month and (c) treatment of placement at 50° C. and 90% humidity for one day. Whiteness was measured by an electric reflectance photometer (ELREPHO, product of Carl-Zeiss using a filter of No. 8 grade) with the results given in Table 5

TABLE 5

| | (a) | (b) | (c) |
|---|---|---|---|
| Ex. 48 | 81.3 | 77.2 | 79.2 |
| 49 | 82.0 | 77.5 | 79.6 |
| 50 | 79.3 | 76.1 | 78.9 |
| 51 | 79.8 | 76.0 | 77.3 |
| 52 | 82.0 | 78.2 | 76.8 |
| Comp. Ex. 9 | 63.0 | 62.3 | 53.2 |
| 10 | 70.2 | 68.0 | 57.4 |
| 11 | 53.0 | 49.5 | 48.0 |
| 12 | 80.2 | 67.0 | 78.7 |
| 13 | 78.2 | 75.3 | 67.2 |
| Ref. Ex. 2 | 81.0 | 77.3 | 79.4 |
| Ref. Ex. 3 | 79.6 | 76.2 | 78.5 |

Table 5 shows self-contained type pressure sensitive manifold papers of Examples and Reference Examples have excellent quality with a little coloration in recording layer even with a lapse of time or with a treatment at high temperature and high humidity.

(V) EXAMPLES OF CONJOINT USE OF LEUCO TYPE RECORDING MATERIAL AND CHELATE TYPE RECORDING MATERIAL

EXAMPLE 53

Preparation of microcapsules containing the ligand compound

A microcapsule dispersion containing the ligand compound was prepared in the same manner as in Example 1.

Preparation of microcapsules containing the color former

A 5 part quantity of crystal violet lactone was dissolved in 100 parts of diisopropylnaphthalene with heating to prepare an oil. In 105 parts of the oil was dissolved 15 parts of aromatic polyisocyanate (trade name, Coronate L, product of Nihon Polyurethane Co., Ltd.). The resulting oil was added to 600 parts of 2% aqueous solution of polyvinyl alcohol and the mixture was emulsified to obtain particles 8.0μ in average size. The emulsion was heated at 80° C. for 4 hours to prepare a capsule dispersion.

Preparation of a Capsule Coating Composition

To a mixture of the above two kinds of capsule dispersions were added 40 parts of wheat starch powder and 20 parts of pulp powder. Water was added thereto in such amount as to achieve 18% solid concentration to prepare a capsule coating composition.

Preparation of a Top Sheet

To 50 parts of 10% aqueous solution of polyvinyl alcohol was added 15 parts of desensitizer-containing ink for leuco type pressure sensitive manifold papers (trade name, desensitizing ink for KS Brite, product of Kanzaki Paper Mfg. Co., Ltd.). The mixture was emulsified by a homogenizer to obtain particles 5μ in average size.

The emulsion was applied by a blade coater to a paper substrate weighing 40 g/m$^2$ in an amount of 3 g/m$^2$ (as solids). To the surface thus coated was applied by an air knife coater the above capsule coating composition in an amount of 6 g/m$^2$ (as solids) to obtain a top sheet having an excellent whiteness.

Preparation of an Under Sheet

An under sheet was prepared in the same manner as in Example 1.

Evaluation Test

The top sheet was superposed on the under sheet and blue, sharp images were formed by a typewriter. The images hardly changed in color density and remained clear after they were marked by red, yellow or green line markers. The images were exposed to sunlight for 3 days but exhibited little or no variation in color density and remained sharp.

EXAMPLE 54

The capsule coating composition of Example 53 was applied by an air knife coater to a paper substrate weighing 40 g/m$^2$ in an amount of 6 g/m$^2$ (as solids). To the surface thus coated was applied by an air knife coater the coating composition for under sheet of Example 53 in an amount of 5 g/m$^2$ by dry weight to prepare a light yellow self-contained type pressure sensitive manifold paper.

Stable, blue-color images were formed by a typewriter without a ribbon.

(VI) EXAMPLES OF PLAIN PAPER TRANSFER TYPE PRESSURE SENSITIVE MANIFOLD PAPER

EXAMPLE 55

A microcapsule dispersion containing the PF compound was prepared in the same manner as in Example 34.

A ligand compound-containing microcapsule dispersion was obtained in the same manner as in Example 1.

Further, an organic base-containing microcapsule dispersion was prepared in the same manner as in Example 23.

Preparation of a Paper Substrate Containing Organic Phosphorous Compound

To 1000 parts of 1% aqueous solution of hydroxyethyl cellulose were added 250 parts of diphenyl, phosphate and 125 parts of talc and the mixture was pulverized by a sand mill. To the resulting dispersion was added 400 parts of styrene-butadiene copolymer latex (50% concentration) to prepare a coating composition.

The coating composition was applied by a roll coater to a paper substrate weighing 40 g/m$^2$ in an amount of 3 g/m$^2$ (as solids).

Preparation of Plain Paper Transfer Type Pressure Sensitive Manifold Papers

In a mixture of the above 3 kinds of capsule dispersions were added 1 part of sodium alkylnaphthalenesulfonate, 40 parts of 5% aqueous solution of hydroxyethyl cellulose and 60 parts of pulp powder. Water was added thereto in such amount as to achieve 18% solid concentration to prepare a capsule coating composition. The capsule coating composition was applied by an air knife coater to the above paper substrate containing the organic phosphorus compound in an amount of 8 g/m$^2$ (as solids) to obtain a plain paper transfer type pressure sensitive manifold paper.

Preparation of an Under Sheet

In 300 parts of water were dissolved 2 parts of sodium polyacrylate and 1 part of polyvinyl alcohol. To the solution was added 100 parts of precipitated calcium carbonate and the mixture was pulverized by a sand mill. To the resulting dispersion was added 15 parts of styrenebutadiene copolymer latex (50% concentration) to obtain a coating composition.

The coating composition was applied by a sizepress to a paper substrate in an amount of 6 g/m$^2$ (as solids) to obtain a paper weighing 46 g/m$^2$.

Evaluation Test

The above plain paper transfer type pressure sensitive manifold paper was superposed on the under sheet and clear images were formed on the under sheet by typewriting without forming images on the transfer layer.

The under sheet was placed at 50° C. and 90% humidity for one day and allowed to place in a room for one month but exhibited little or no variation in the image portion and no variation in the non-image portion.

EXAMPLE 56

To 100 parts of 2% aqueous solution of phosphated starch was added 50 parts of diphenyl phosphate and the mixture was pulverized by a sand mill. To the resulting dispersion were added 3 kinds of microcapsule dispersions containing the PF compound, the ligand compound and the organic base respectively prepared in the same manner as in Example 55. To the mixture were added 1 part of Turkey red oil, 30 parts of pulp powder and 30 parts of starch powder. Water was added thereto in such amount as to achieve 25% solid concentration to prepare a coating composition. The coating composition was applied by an air knife coater to a paper substrate weighing 40 g/m$^2$ in an amount of 10 g/m$^2$ (as solids) to obtain a plain paper transfer type pressure sensitive manifold paper.

Preparation of an Under Sheet

To a mixture of 50 parts of LBKP (hardwood bleached kraft pulp) and 50 parts of NBKP (softwood bleached kraft pulp) which are beated to a freeness of 40 (Schopper-Riegler) were added 50 parts of calcium carbonate and 1 part of alkyl ketene dimer to obtain a slurry having a solid concentration of about 0.3%. A paper weighing 70 g/m$^2$ was prepared by a usual Fourdrinier paper machine with use of the above slurry.

Evaluation Test

The above plain paper transfer type pressure sensitive manifold paper was superposed on the under sheet and clear images were formed by typewriting on the under sheet without forming images on the transfer layer. The under sheet exhibited an excellent stability in both portions with and without images in the same manner as in Example 55.

Reference Example 4

A plain paper transfer type pressure sensitive manifold paper was prepared in the same manner as in Example 55 except that the organic base-containing microcapsule dispersion was not used.

The above paper was superposed on an under sheet prepared in the same manner as in Example 55 and sharp images were formed by typewriting on the under sheet without forming images on the transfer layer.

The under sheet was placed at 50° C. and 90% humidity for one day and allowed to place in a room for one month but exhibited little or no variation in the image portion and no variation in the non-image portion.

(VII) EXAMPLE OF A SET OF SELF-CONTAINED TYPE PRESSURE SENSITIVE MANIFOLD PAPERS

EXAMPLE 57

Preparation of a Microcapsule Coating Composition Containing the Ligand Compound A ligand compound-containing microcapsule dispersion was prepared in the same manner as in Example 1.

To the dispersion were added 20 parts of wheat starch powder and 10 parts of pulp powder. Water was added thereto in such amount as to achieve 18% solid concentration to obtain a capsule coating composition.

Preparation of a Coating Composition Containing the PF Compound

A slurry containing the PF compound was prepared in the same manner as in Example 1. The slurry was dried to obtain fine powder of the PF compound.

To 150 parts of water were added 1 part of sodium polyphosphate, 15 parts of the fine powder of the PF compound, 35 parts of titanium oxide, 50 parts of pricipitated calcium carbonate and 15 parts of 40% paraffin wax emulsion (trade name, Cellosol A, product of Chukyo Fat and Oil Co., Ltd.) and the mixture was fully dispersed. To the dispersion was added 16 parts of styrene-butadiene copolymer latex (50% concentration) to obtain a coating composition.

Preparation of a Microcapsule Coating Composition Containing a Color Former

A 5 part quantity of crystal violet lactone was dissolved in 100 parts of diisopropylnaphthalene with heating to obtain an oil. The oil was added to 200 parts of 10% aqueous solution of acid-treated gelatin having an isoelectric point of 8.0 and the mixture was treated by a homogenizer to obtain an emulsion containing particles 5.0μ in average size. To the emulsion was added 500 parts of 0.5% aqueous solution of carboxymethyl cellulose (average polymerization degree of 160 and substitution degree of 0.6) having a temperature of 50° C. The system was adjusted to a pH of 5 with 5% aqueous solution of sodium hydroxide and vigorously stirred until the system was cooled to 10° C. Thereafter 3 parts of 50% aqueous solution of glutaraldehyde was added to the system and the mixture was adjusted to a pH of 8.0 with 5% aqueous solution of sodium hydroxide. Then the mixture was stirred for 5 hours to complete curing of the capsules.

To the capsule dispersion were added 30 parts of pulp powder and 50 parts of 10% aqueous solution of starch to prepare a capsule coating composition.

Preparation of Self-Contained Type Pressure Sensitive Manifold Paper

The capsule coating composition containing the ligand compound was applied by an air knife coater to a paper substrate weighing 40 g/m$^2$ in an amount of 6 g/m$^2$ (as solids). To the surface thus coated was applied by an air knife coater the coating composition containing the PF compound in an amount of 6 g/m$^2$ (as solids) to form a self-contained type pressure sensitive manifold layer.

To the reverse side of the above sheet was applied by an air knife coater the capsule coating composition containing the color former in an amount of 4 g/m$^2$ (as solids) to prepare a self-contained type pressure senstive manifold paper.

Preparation of a Coating Composition Containing a Color Acceptor and an Under Sheet In 300 parts of water were added 65 parts of aluminum hydroxide, 20 parts of zinc oxide, 15 parts of molten mixture of zinc salt of 3,5-di(α-methylbenzyl) salicylic acid and α-methylstyrene-styrene copolymer (80/20 ratio) and 5 parts (as solids) of an aqueous solution of polyvinyl alcohol. The mixture was pulverized by a ball mill for 24 hours. To the resulting dispersion was added 20 parts (as solids) of carboxyl-modified styrene-butadiene copolymer latex to obtain a color acceptor coating composition. The coating composition was applied by an air knife coater to a paper substrate weighing 40 g/m$^2$ in an amount of 5 g/m$^2$ (as solids) to prepare an under sheet.

Preparation of a Microcapsule Coating Composition Containing a Color Former

A 5 part quantity of 2-methyl-6-(N-p-tolyl-N-ethylamino)fluoran was dissolved in 100 parts of diisopropylnaphthalene with heating to obtain an oil. A 20% aqueous solution of sodium hydroxide was added to a mixture of 210 parts of aqueous solution containing 10 parts of urea and 1 part of resorcin and 100 parts of 10% aqueous solution of ethylene-maleic anhydride copolymer to prepare an aqueous solution having a pH of 3.5. The oil was added to the aqueous solution and emulsified to obtain a dispersion of particles 5μ in average size. To the dispersion was added 25 parts of 37% aqueous solution of formaldehyde and the mixture was stirred at 70° C. for 4 hours to prepare a capsule dispersion.

To the capsule dispersion were added 20 parts of wheat starch powder and 10 parts of pulp powder. Water was added thereto in such amount as to achieve 18% solid concentration to obtain a capsule coating composition.

Preparation of a Middle Sheet

The capsule coating composition containing the color former [2-methyl-6-(N-p-tolyl-N-ethylamino)fluoran] was applied by an air knife coater to the reverse side of the above under sheet in an amount of 4 g/m$^2$ (as solids) to prepare a middle sheet.

Evaluation Test

A set of self-contained type pressure sensitive manifold papers was obtained by superposing the above pressure sensitive manifold paper of self-contained type, the middle sheet and the under sheet. The set had an excellent whiteness and images were formed by a typewriter without a ribbon, the images being colored in black purple, blue and red from the above. Images were also formed by typewriting without a ribbon after plasticizer (dibutyl phthalate) adhered to the upper surface of the set. Sharp images were formed both in the portions with or without plasticizer.

We claim:

1. In a recording material producing images due to a complex formed from an organic phosphorus-iron compound having a bond of at least one of $PO^-$ with $Fe^{3+}$ and $PS^-$ with $Fe^{3+}$ in the molecule and a ligand compound which reacts with the organic phosphorus-iron compound, the improvement wherein at least one of (a) a colorless or light-colored oil-soluble or heat-fusible organic compound adheres to the surface of the organic phosphorus-iron compound and (b) an organic base is present out of contact with the organic phosphorus-iron compound.

2. A recording material as defined in claim 1 wherein the organic phosphorus-iron compound comprises at least one of organic phosphorus compounds represented by the following formulae (I) to (XVIII) in which the hydrogen of P—OH or P—SH is substituted with $Fe^{3+}$:

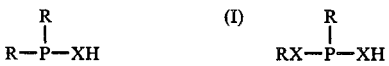
(I)

(II)

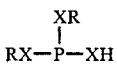
(III)

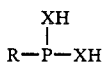
(IV)

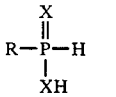
(V)

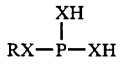
(VI)

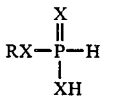
(VII)

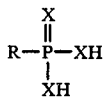
(VIII)

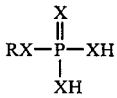
(IX)

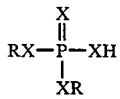
(X)

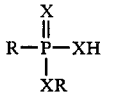
(XI)

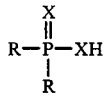
(XII)

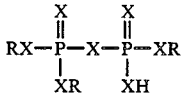
(XIII)

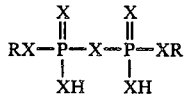
(XIV)

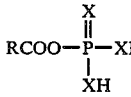
(XV)

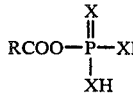
(XVI)

-continued

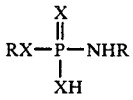
(XVII)

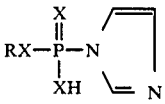
(XVIII)

wherein X is the same or different and represents oxygen atom or sulfur atom and R is the same or different and represents alkyl group or aryl group.

3. A recording material as defined in claim 1 wherein the organic phosphorus-iron compound comprises a composite iron salt resulting from the reaction between $Fe^{3+}$, at least one of the organic phosphorus compounds of the formulae (I) to (XVIII) and at least one of acids represented by the formula

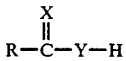
(XIX)

wherein R and X are as defined above and Y is oxygen or sulfur.

4. A recording material as defined in claim 1 wherein the organic phosphorus-iron compound comprises a composite iron salt resulting from the reaction between $Fe^{3+}$, at least one of the organic phosphorus compounds of the formulae (I) to (XVIII), at least one of the acids of the formula (XIX) and at least one of organic sulfur compounds having a bond of S—OH.

5. A recording material as defined in claim 1 wherein the oil-soluble or heat-fusible organic compound comprises an organic acid or a metal salt thereof.

6. A recording material as, defined in claim 5 wherein the organic acid comprises at least one compound selected from the group consisting of (a) the organic phosphorus compounds of the formulae (I) to (XVIII), (b) the acids of the formula (XIX) and (c) the organic sulfur compounds having a bond of S—OH.

7. A recording material as defined in claim 1 wherein the organic base comprises at least one compound selected from the group consisting of aliphatic amines, aromatic amines, alicyclic amines, amidines, guanidines, nitrogen-containing heterocyclic compounds and heterocyclic amines.

8. A recording material as defined in claim 1 wherein in portions which require no image is formed a desensitizer layer comprising at least one compound selected from the group consisting of (a) organic phosphorus compounds having a bond of at least one of P—H and P—SH, (b) organic compounds having an aminocarboxyl group and (c) salts of these compounds (a) and (b).

9. A recording material as defined in claim 8 wherein the organic phosphorus compound comprises one represented by the formulae (I) to (XVIII).

10. A recording material as defined in claim 8 wherein the organic phosphorus compound comprises a phosphate of glycol or phosphate of polyoxyalkyleneamine.

11. A recording material as defined in claim 8 wherein the organic compound having an aminocarboxyl group comprises at least one of polyalkylenepolyamine polycarboxylic acids, cycloalkanepolyamine polycarboxylic acids, ether polyamine polycarboxylic acids, nitrilotriacetic acid and these acids having substituent(s).

* * * * *